United States Patent [19]

Naruo et al.

[11] Patent Number: 4,586,020

[45] Date of Patent: Apr. 29, 1986

[54] SHEATHED RESISTANCE HEATER

[75] Inventors: Noboru Naruo; Hidekata Kawanishi, both of Osaka, Japan

[73] Assignee: Matsushita Electric Industrial Company, Limited, Osaka, Japan

[21] Appl. No.: 460,242

[22] PCT Filed: May 17, 1982

[86] PCT No.: PCT/JP82/00171

§ 371 Date: Jan. 17, 1983

§ 102(e) Date: Jan. 17, 1983

[87] PCT Pub. No.: WO82/04171

PCT Pub. Date: Nov. 25, 1982

[30] Foreign Application Priority Data

| | | | |
|---|---|---|---|
| May 18, 1981 | [JP] | Japan | 56-75203 |
| May 18, 1981 | [JP] | Japan | 56-75204 |
| May 18, 1981 | [JP] | Japan | 56-75206 |
| May 19, 1981 | [JP] | Japan | 56-76208 |
| May 19, 1981 | [JP] | Japan | 56-76235 |
| May 20, 1981 | [JP] | Japan | 56-77182 |

[51] Int. Cl.[4] ..... H01C 1/03

[52] U.S. Cl. ..... 338/238; 174/102 P; 219/544; 219/552; 338/243; 338/274; 501/108

[58] Field of Search ..... 338/238–242, 338/243, 273, 274; 29/611, 614; 219/530, 540, 541, 544, 552, 553; 252/500, 521; 106/47 R, 58, 62; 174/102 P, 118; 501/108, 112

[56] References Cited

U.S. PATENT DOCUMENTS

| | | | |
|---|---|---|---|
| 2,280,515 | 4/1942 | Ridgway et al. | 338/238 X |
| 2,280,516 | 4/1942 | Ridgway et al. | 338/238 X |
| 3,369,209 | 2/1968 | Edwin et al. | 338/238 |
| 3,477,058 | 4/1969 | Vedder et al. | 338/238 |
| 3,621,204 | 11/1971 | Neidhardt et al. | 219/553 |
| 3,622,755 | 11/1971 | Vedder | 219/544 |
| 4,280,932 | 7/1981 | Borom et al. | 252/521 |
| 4,506,251 | 3/1985 | Narvo et al. | 338/238 |

FOREIGN PATENT DOCUMENTS

| | | |
|---|---|---|
| 1565279 | 1/1972 | Fed. Rep. of Germany . |
| 1192367 | 4/1959 | France . |
| 852693 | 10/1960 | United Kingdom . |
| 1101275 | 1/1968 | United Kingdom . |

*Primary Examiner*—Volodymyr Y. Mayewsky

*Attorney, Agent, or Firm*—Lowe, King, Price & Becker

[57] ABSTRACT

This invention relates to a sheathed resistance heater which comprises a metal pipe (3), a heating wire (2) received in the metal pipe, and an electrically insulating powder (4) filled in the pipe and also to a method for fabricating same. The electrically insulating powder (4) contains 0.1–10 wt % of the specific type of an oxide by which the heater has a prolonged life because the oxide serves to suppress the metallic component of the heating wire (2) from evaporating, and its insulation resistance under self-heating conditions can be prevented from lowering. The heater has wide utility in both domestic and industrial fields.

1 Claim, 27 Drawing Figures

INSULATION RESISTANCE UNDER SELF-HEATING CONDITIONS

SHEATHED RESISTANCE HEATER

TECHNICAL FIELD

This invention relates to a sheathed resistance heater which comprises a metal pipe receiving therein a heating wire and an electrically insulating powder packed in the metal pipe whereby the heater has a prolonged life and exhibits a high level of insulation resistance in a working condition after having been used over a long time.

BACKGROUND ART

Sheathed resistance or electric heaters have been widely used in many fields because of their very excellent performance, quality and convenience, extending the commercial range including not only domestic electric articles, but also specific applications such as in various industries, space developments, atomic power services and the like. Among various classes of sheathed resistance heaters, sheathed heaters for high temperature purposes are considered to have more and more increasing applications in the future.

Upon reviewing the performance and quality of sheathed resistance heaters in a world-wide sense, they have drawbacks in that the insulation resistance of the heaters in a working condition (hereinafter referred to as insulation resistance under self-heating conditions) lowers as a function of time, coupled with another disadvantage that it takes only a short time before disconnection of the heating wire.

DISCLOSURE OF THE INVENTION

The present invention contemplates to provide a sheathed resistance heater and a method for fabricating the heater, in which an electrically insulating powder used is a powder admixed with the specific type of a powder whereby the heater has a prolonged life before breakage of the heating wire and exhibits high insulation resistance under self-heating conditions even after its long-term use.

BRIEF DESCRIPTION OF THE DRAWINGS

FIGS. 2–27 refer to embodiments of the present invention, in which FIGS. 2, 5, 8, 11, 14, 17, 20 and 23 are characteristic graphs of the insulation resistance under self-heating conditions in relation to variation in test period, FIGS. 3, 6, 9, 12, 15, 18, 21, 24, 26 and 26 are characteristic graphs of the insulation resistance under self-heating conditions in relation to variation in amounts of oxides, and FIGS. 4, 7, 10, 13, 16, 19, 22 and 25 are characteristic graphs of the life in relation to variation in amounts of oxides.

BEST MODE FOR CARRYING OUT THE INVENTION

Embodiments of the present invention are described with reference to the accompanying drawings.

Figure 1:
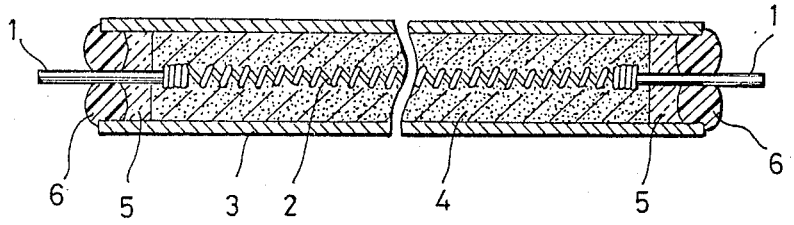
FIG. 1 PRIOR ART
FIG. 1 is a sectional view of an ordinary sheathed resistance heater.

In general, a sheathed resistance heater comprises, as particularly shown in FIG. 1, a coil-like heating wire 2 provided with terminal bars 1 at opposite ends thereof, a metal pipe 3 receiving the heating wire therein, and an electrically insulating powder 4 such as of electrofused magnesia, electrofused silica, electrofused alumina or the like which is filled up in the metal pipe. Optionally, the metal pipe 3 may be sealed with a glass 5 and a heat-resistant resin 6 at opposite sides thereof.

We have paid particular attention to the electrically insulating powder 4 and made extensive studies on the powder.

[EXAMPLE 1]

An electrofused magnesia powder was used as a main component of the electrically insulating powder 4, which was admixed with NiO in different amounts to obtain samples of electrically insulating powder 4.

The electrofused magnesia powder had a composition indicated in Table 1 below.

TABLE 1

| | |
|---|---|
| MgO | 96–97 wt % |
| CaO | 0.2–0.3 wt % |
| $SiO_2$ | 2–3 wt % |
| $Al_2O_3$ | 0.4–0.5 wt % |
| $Fe_2O_3$ | 0.14–0.16 wt % |

The heating wire 2 used was a nichrome wire of the first kind having a diameter of 0.29 mm and wound in the form of a coil with a winding diameter of 2 mm. The wire was connected with terminal bars 1 at opposite ends thereof. The metal pipe 3 used was a pipe, NCF2P (commercial name Incoroi 800), having a length of 413 mm, an outer diameter of 8 mm and a thickness of 0.46 mm.

Into each of the metal pipes 3 was inserted the heating wire 2 provided with the terminal bars 1 at opposite ends. Thereafter, the electrically insulating powder 4 which had previously been prepared was filled up in the metal pipe 3, followed by subjecting the pipe to the steps of rolling for reducing the diameter and annealing (1050° C., 10 minutes) to make the length and outer diameter at 500 mm and 6.6 mm, respectively. The metal pipe 3 was sealed at opposite ends thereof with a low melting glass 5 and a heat-resistant resin 6. As a result, sheathed resistance heaters of sample Nos. 12–18 were fabricated.

The content of NiO in the insulating powders used in the sheathed heaters of sample Nos. 12–18 is shown in Table 2.

For comparison purposes, a conventional sheathed heater (sample No. 11) was made using an electrically insulating powder 4 consisting of the electrofused magnesia powder alone whose composition was shown in Table 1.

In order to determine the insulation and life performances of each of the sheathed heaters numbered as 11–18, the following tests were conducted.

First, the insulation resistance was measured, as an initial characteristic of sheathed heater, under conditions where the surface temperature of the metal pipe was 750° C. The results are shown in Table 2.

Figure 2:
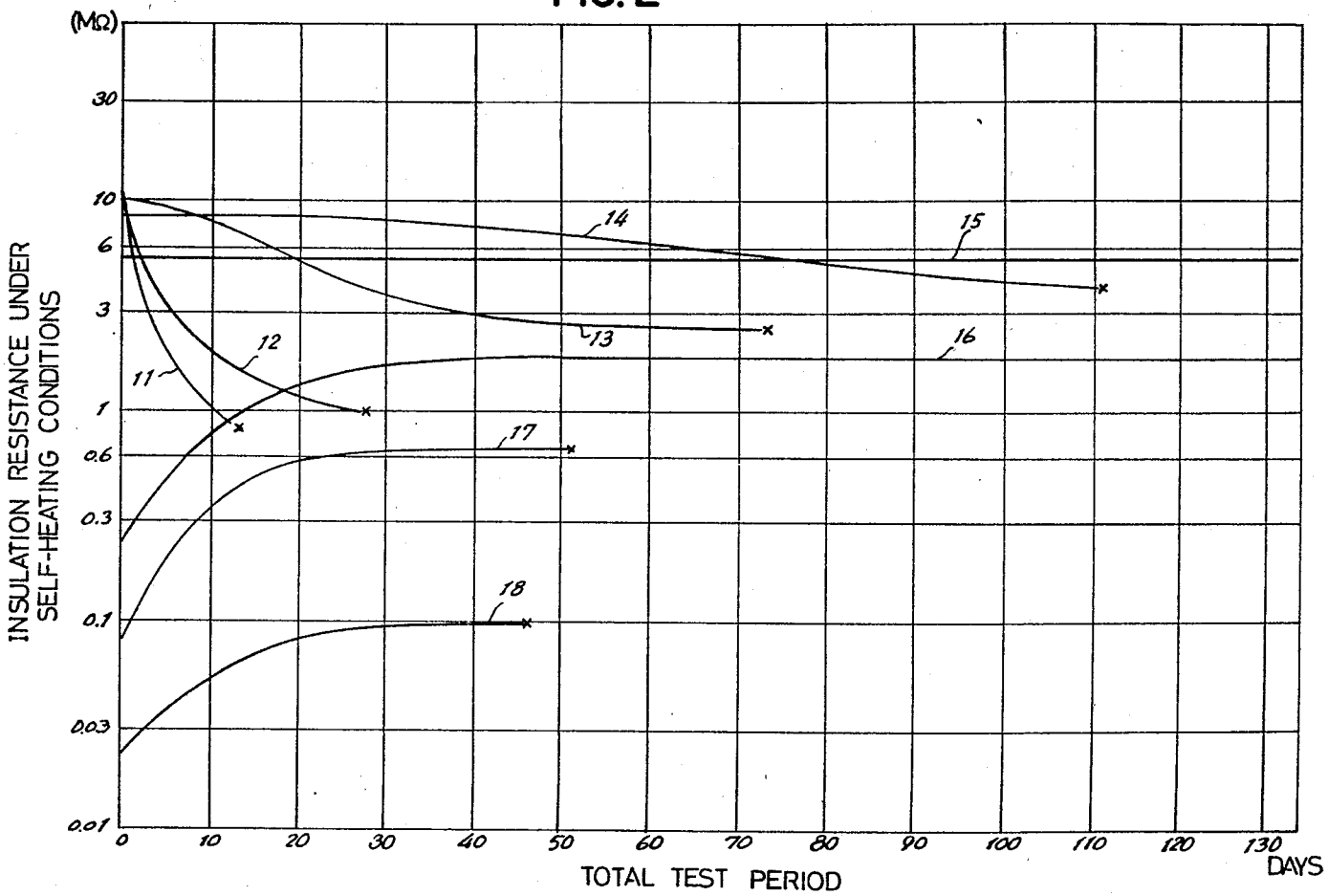

The variation in the insulation resistance under self-heating conditions was measured by continuously energizing the heating wire 2 so that the surface temperature of the metal pipe was maintained at 950° C. It will be noted here that at the time when the insulation resistance under self-heating conditions was measured, the surface temperature of the metal pipe 3 was lowered down to 750° C. The variation in the insulation resistance under self-heating conditions is shown in FIG. 2. In FIG. 2, curves 11–18 correspond to the sheathed heaters of sample Nos. 11–18, respectively.

Figure 3:
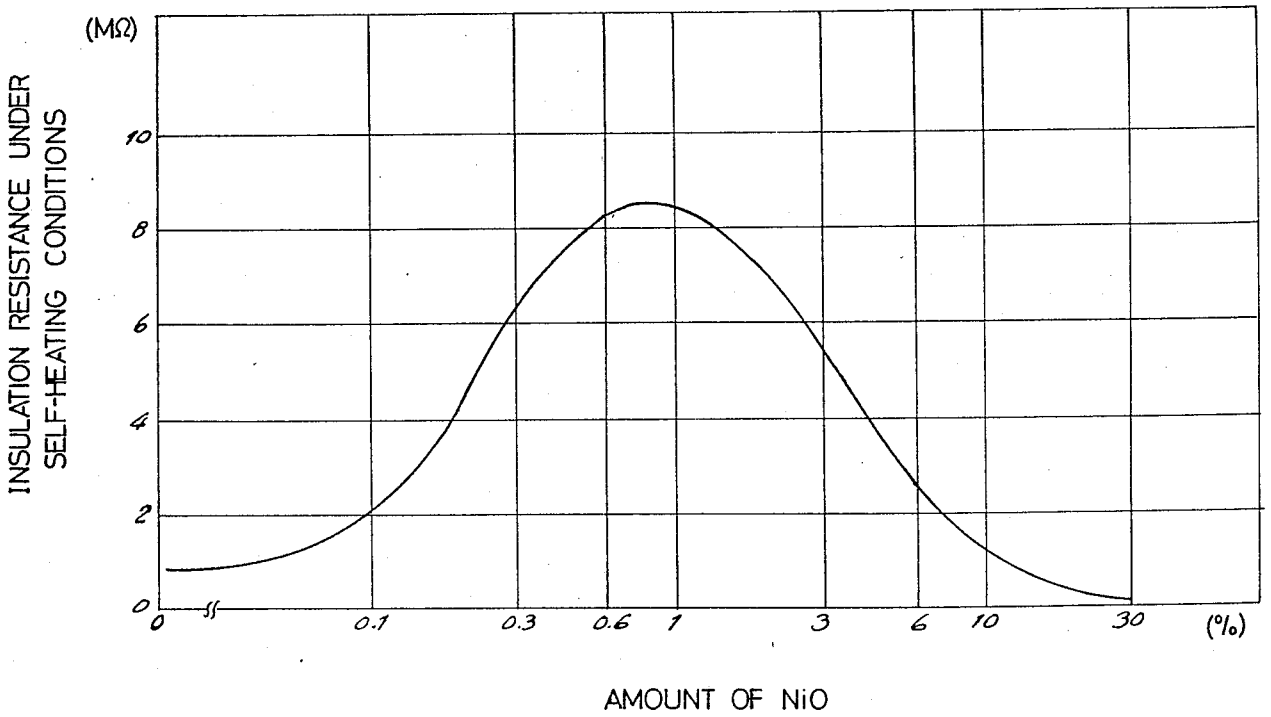

The insulation resistance values of the respective samples 11 days after commencement of the continuous energizing test are shown in Table 2. The relation between the content of NiO and the insulation resistance value under self-heating conditions 11 days after commencement of the continuous energizing test is shown in FIG. 3.

Figure 4:
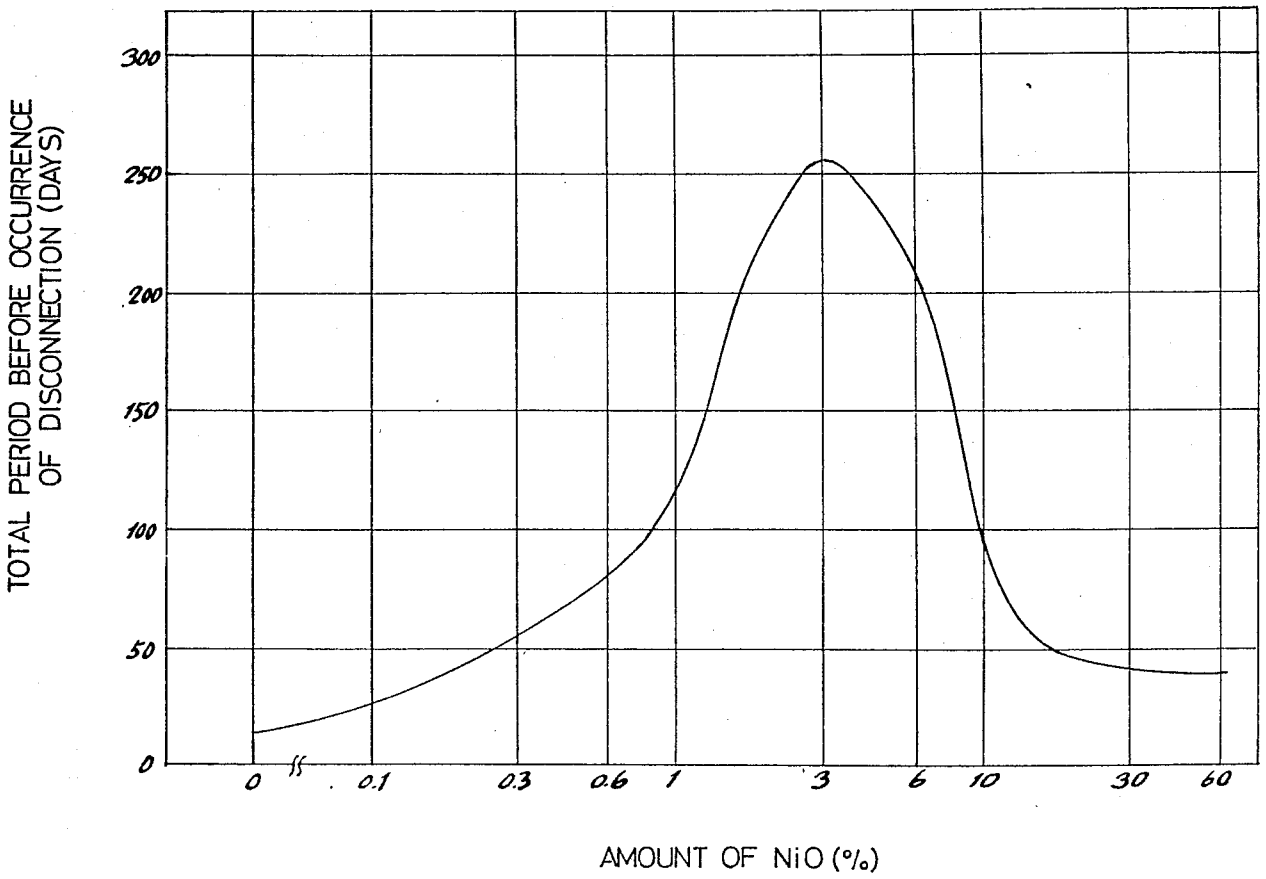

The continuous test was further continued on each of the sheathed heaters numbered as 11–18 to determine the number of days (life) before the heating wire 2 was disconnected. The test results are shown in Table 2 and the relation between the content of NiO and the life is shown in FIG. 4.

TABLE 2

| Sample No. | Content of NiO (wt %) | Initial Insulation Resistance Value under Self-Heating Conditions (Mega Ohms) | Insulation Resistance Value under Self-heating Conditions after 11 Days (Mega Ohms) | Life (Days) |
|---|---|---|---|---|
| 11 | 0.0 | 20 | 0.95 | 13 |
| 12 | 0.1 | 13 | 2.0 | 28 |
| 13 | 0.5 | 10 | 7.8 | 73 |
| 14 | 1.0 | 8.5 | 8.5 | 111 |
| 15 | 3.0 | 5.5 | 5.4 | 255 |
| 16 | 10.0 | 0.24 | 1.2 | 95 |
| 17 | 15.0 | 0.085 | 0.38 | 51 |
| 18 | 30.0 | 0.025 | 0.06 | 46 |

As will be apparent from the results of Table 2 and FIG. 2, the sheathed heaters of sample Nos. 12–16 in which there were used the electrically insulating powders having a NiO content of 0.1–10 wt% were less lowered in insulation resistance under self-heating conditions than the known sheathed heater numbered as 11. The sheathed heaters of sample Nos. 17 and 18 which made use of electrically insulating powders having NiO contents over 15 wt% had low initial insulation resistance values under self-heating conditions immediately after fabrication of the heaters and could not stand practical use.

FIG. 3 reveals that the sheathed heaters (sample Nos. 12–16) in which the content of NiO was in the range of 0.1–10 wt% exhibited higher insulation resistance values under self-heating conditions 11 days after commencement of the continuous energizing test than the known sheathed heater of sample No. 11.

Moreover, FIG. 4 reveals that the sheathed heaters (sample Nos. 12–16) in which the content of NiO was in the range of 0.1–10 wt% was longer in life than the known sheathed heater of sample No. 11.

Thus, the sheathed heaters which made use of electrically insulating powders admixed with NiO in amounts ranging from 0.1–10 wt% exhibited less lowered insulation resistance values under self-heating conditions and a prolonged life.

[EXAMPLE 2]

An electrofused magnesia powder was used as a main component of the electrically insulating powder 4 and admixed with CoO in different amounts to obtain several samples of electrically insulating powder 4.

Subsequently, the general procedure of Example 1 was repeated to obtain sheathed resistance heaters of sample Nos. 19–24.

These heaters were each subjected to the measurement of the initial insulation resistance under self-heating conditions, variation of the insulation resistance under self-heating conditions in relation to time, and life in the same manner as in Example 1.

Among the results of the measurement, the initial insulation resistance under self-heating conditions, insulation resistance under self-heating conditions after 11 days and life of each of the sample heaters are shown in Table 3.

Figure 5:
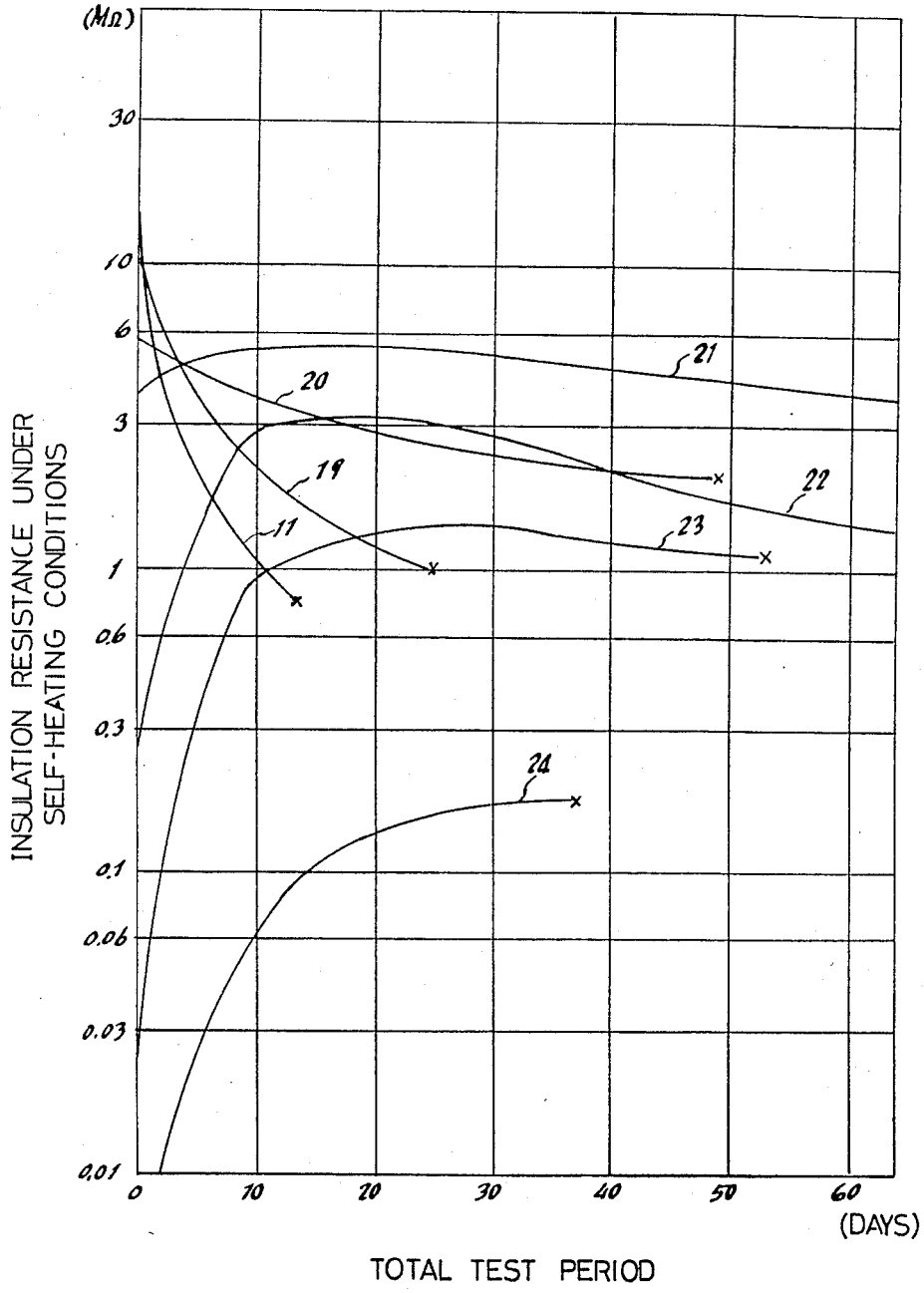
Figure 6:
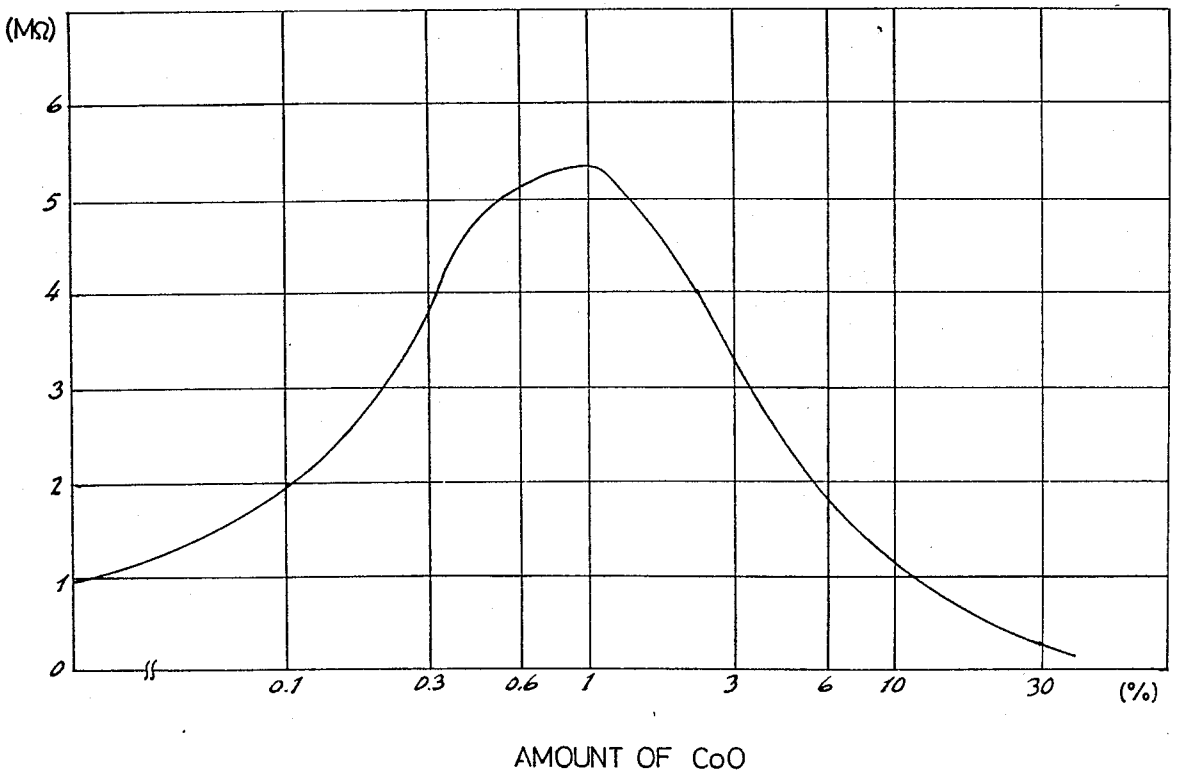
Figure 7:
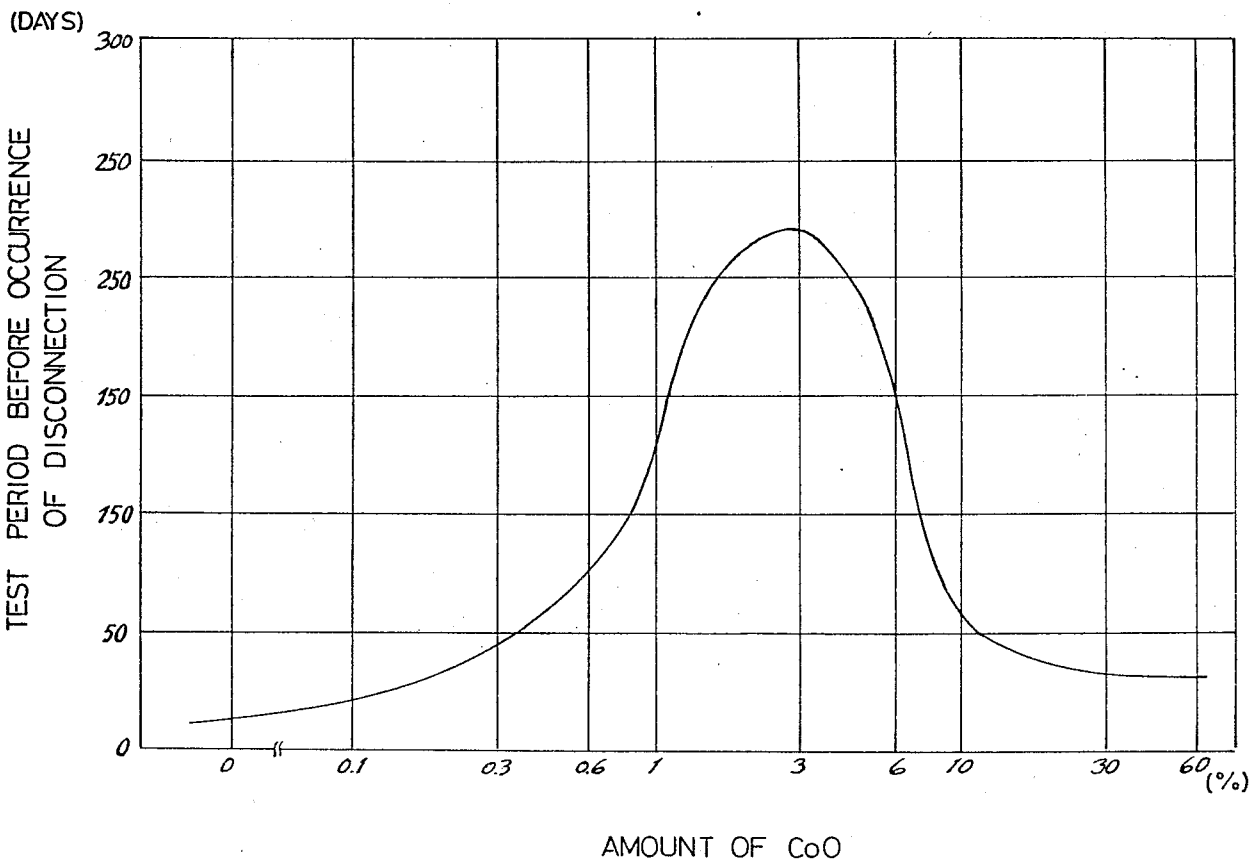

FIG. 5 shows the variation of the insulation resistance under self-heating conditions in relation to time, and FIG. 6 shows the relation between the content of CoO and the insulation resistance under self-heating conditions after 11 days. In FIG. 7, there is shown the relation between the content of CoO and the life.

In FIG. 5, curves 19–24 correspond to the sheathed resistance heaters of sample Nos. 19–, 24, respectively.

TABLE 3

| Sample No. | Content of CoO (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 19 | 0.1 | 11 | 2.0 | 25 |
| 20 | 0.3 | 5.8 | 3.5 | 49 |
| 21 | 1.0 | 3.7 | 5.3 | 125 |
| 22 | 3.0 | 0.25 | 3.0 | 220 |
| 23 | 10.0 | 0.02 | 1.2 | 53 |
| 24 | 30.0 | <0.01 | 0.075 | 37 |

As will be apparent from the results of Table 3 and FIG. 5, the sheathed heaters of sample Nos. 19–23 in which the electrically insulating powders had CoO in amounts ranging from 0.1–10 wt% exhibited less lowered insulation resistance values under self-heating conditions than the sheathed heater of sample No. 11 and were thus good. The sheathed resistance heater numbered as 24 was low in the initial insulation resistance under self-heating conditions and could not be used for practical purposes.

As is clearly seen from FIG. 6, The sheathed heaters in which the content of CoO was in the range of 0.1–10 wt% exhibited high insulation resistance values under self-heating conditions 11 days after commencement of the continuous energizing test than the sheathed heater of sample No. 11.

Moreover, the results of FIG. 7 reveal that the sheathed heaters in which the content of CoO was in th range of 0.1–10 wt% had a more prolonged life performance than the known sheathed heater of sample No. 11.

Thus, the sheathed resistance heaters which made use of electrically insulating powders 4 having a CoO content ranging from 0.1–10 wt% had less reduced values of insulation resistance under self-heating conditions and a longer life.

[EXAMPLE 3]

An electrofused magnesia powder was used as a main component of the electriccally insulating powder 4 and admixed with a mixture of NiO and CoO in different amounts to obtain several samples of electrically insulating powder 4. It will be noted that NiO and CoO were used in equal amounts.

Subsequently, the general procedure of Example 1 was repeated to obtain sheathed resistance heaters of sample Nos. 25–30.

These sheathed heaters were each subjected to the measurement of the initial insulation resistance under self-heating conditions, variation of insulation resistance under self-heating conditions in relation to time, and life.

Among the results of the measurement, the initial insulation resistance values under self-heating conditions, insulation resistance values under self-heating conditions after 11 days and life are shown in Table 4.

Figure 8:
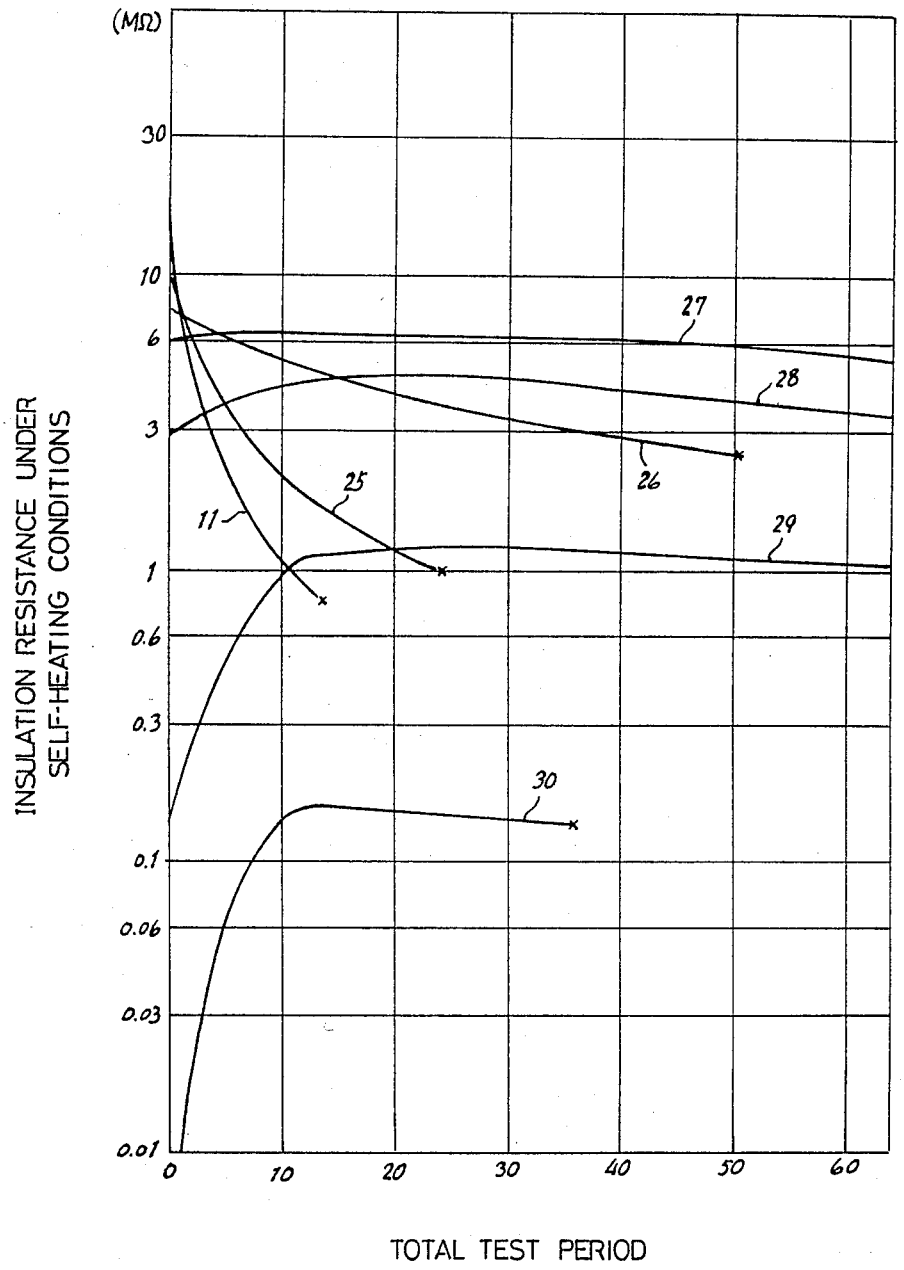
Figure 9:
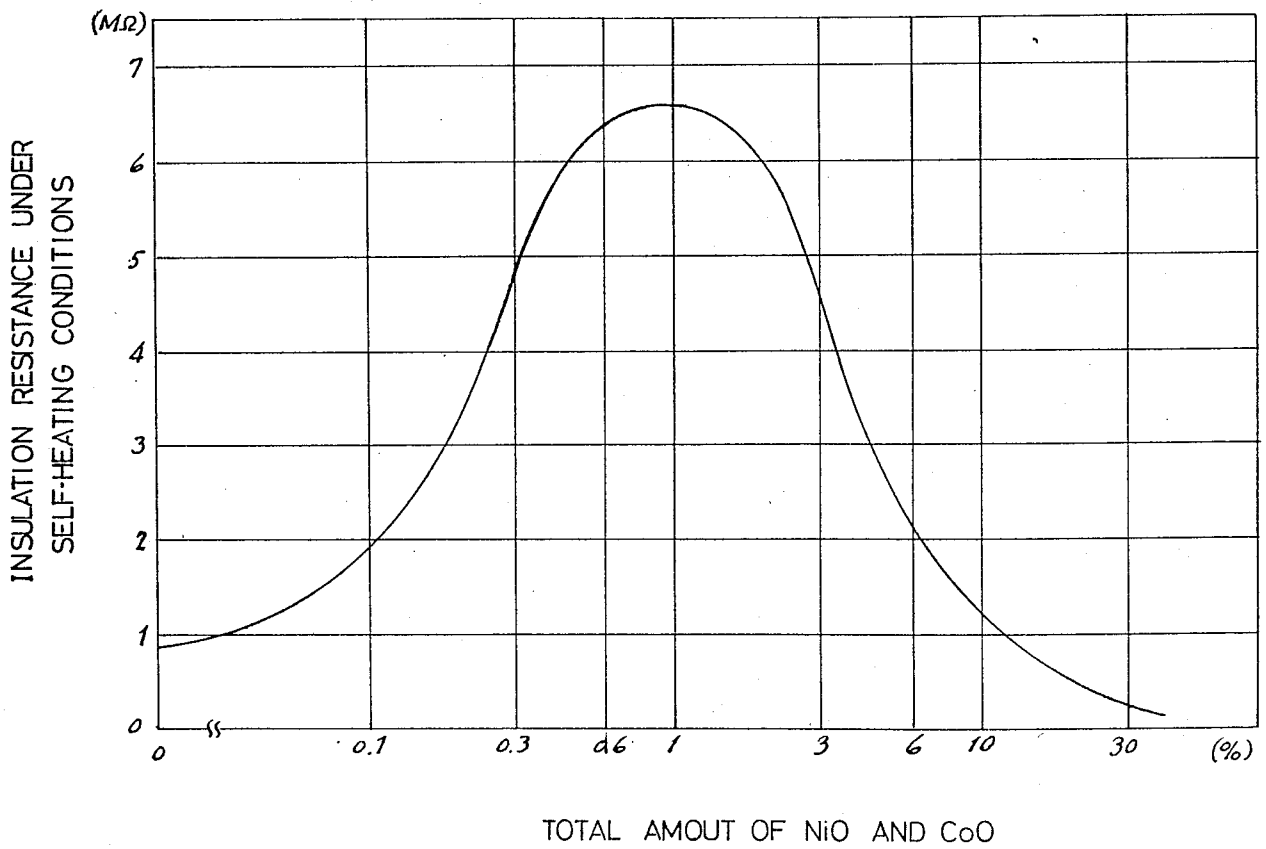
Figure 10:
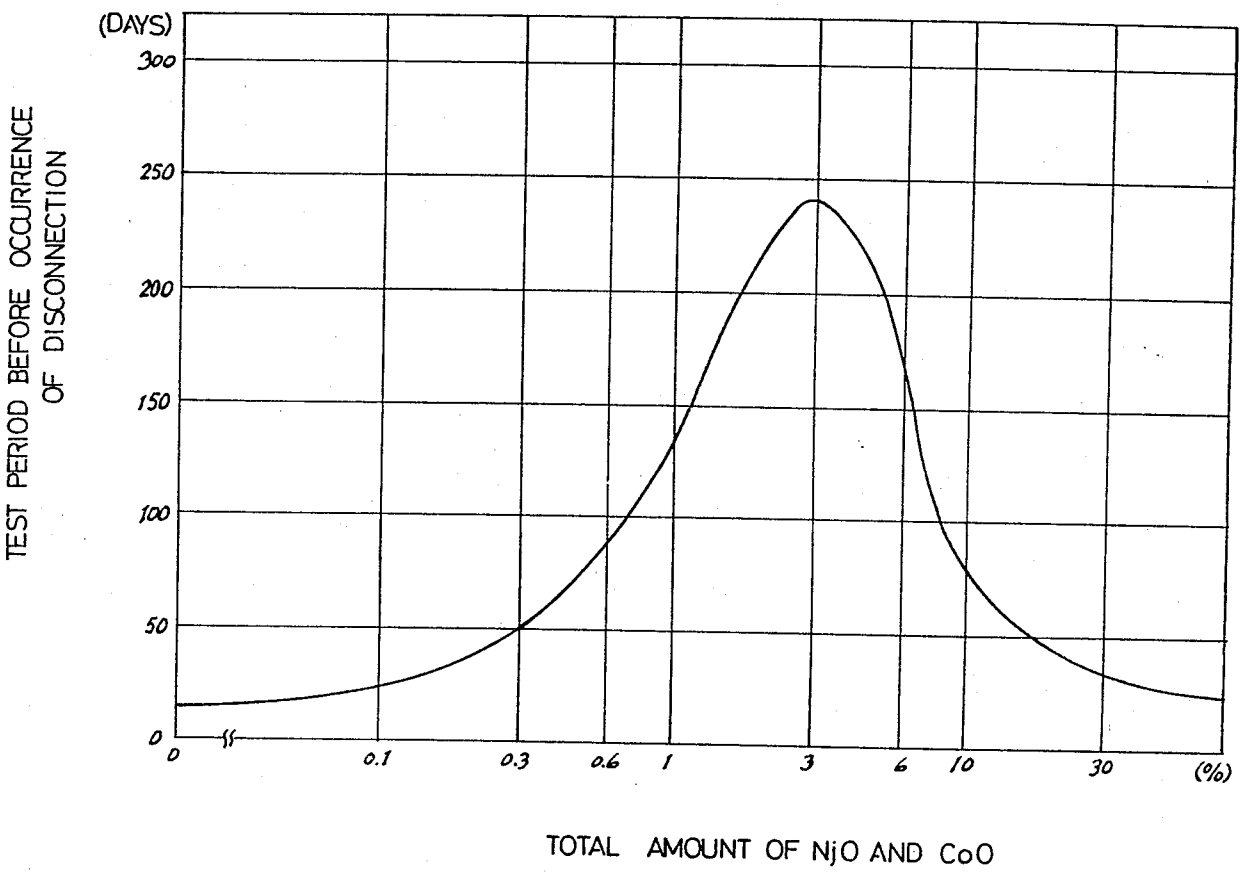

FIG. 8 shows the variation of the insulation resistance under self-heating conditions in relation to time and FIG. 9 shows the relation between the total content of NiO and CoO and the insulation resistance value under self-heating conditions after 11 days. In FIG. 10, there is shown the relation between the total amount of NiO and CoO and the life.

In FIG. 8, curves 25–30 correspond to the sheathed heaters of sample Nos. 25–30, respectively.

TABLE 4

| Sample No. | Total Amount of NiO & CoO (wt %) | Initial Insulation Resistance under Self heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 25 | 0.1 | 11 | 2.0 | 24 |
| 26 | 0.3 | 8 | 5.0 | 50 |
| 27 | 1.0 | 6 | 6.3 | 128 |
| 28 | 3.0 | 2.8 | 4.4 | 240 |
| 29 | 10.0 | 0.12 | 1.1 | 76 |
| 30 | 30.0 | <0.01 | 0.15 | 36 |

As will be apparent from the results of Table 4 and FIG. 8, th sheathed resistance heaters of sample Nos. 25–29 in which the electrically insulating powders containing NiO and CoO in total amounts of 0.1–10 wt% were used exhibited less reduced insulation resistance values under self-heating conditions than the sheathed heater of sample No. 11 and were thus good. The sheathed heater for comparison numbered as 30 was low in the initial insulation resistance value under self-heating conditions and could not be used for practical purposes.

The results of FIG. 9 reveal that the sheathed heaters in which the total content of NiO and CoO used was in the range of 0.1–10 wt% exhibited higher insulation resistance values as measured under self-heating conditions 11 days after commencement of the continuous energizing test than the conventional sheathed resistance heater of sample No. 11.

Moreover, as will be apparent from FIG. 10, the sheathed heaters in which the total content of NiO and CoO was in the range of 0.1–10 wt% had a more prolonged life than the conventional sheathed heater numbered as 11.

Thus, the sheathed resistance heaters which were fabricated using the electrically insulating powders 4 in which the total content of NiO and CoO was in the range of 0.1–10 wt% were found to have less reduced insulation resistance values under self-heating conditions and a prolonged life.

[EXAMPLE 4]

An electrofused magnesia powder was used as a main component of the electrically insulating powder 4 and admixed with $Co_2O_3$ in different amounts to obtain several samples of electrically insulating powder 4.

Thereafter, the general procedure of Example 1 was repeated thereby obtaining sheathed resistance heaters of sample Nos. 31–36.

These heaters were each subjected to the measurement of the initial insulation resistance, variation in the insulation resistance in relation to time, and life.

Among the results of the measurement, there are shown in Table 5 the initial insulation resistance values under self-heating conditions, variation in the insulation resistance under self-heating conditions in relation to time, and life.

Figure 11:
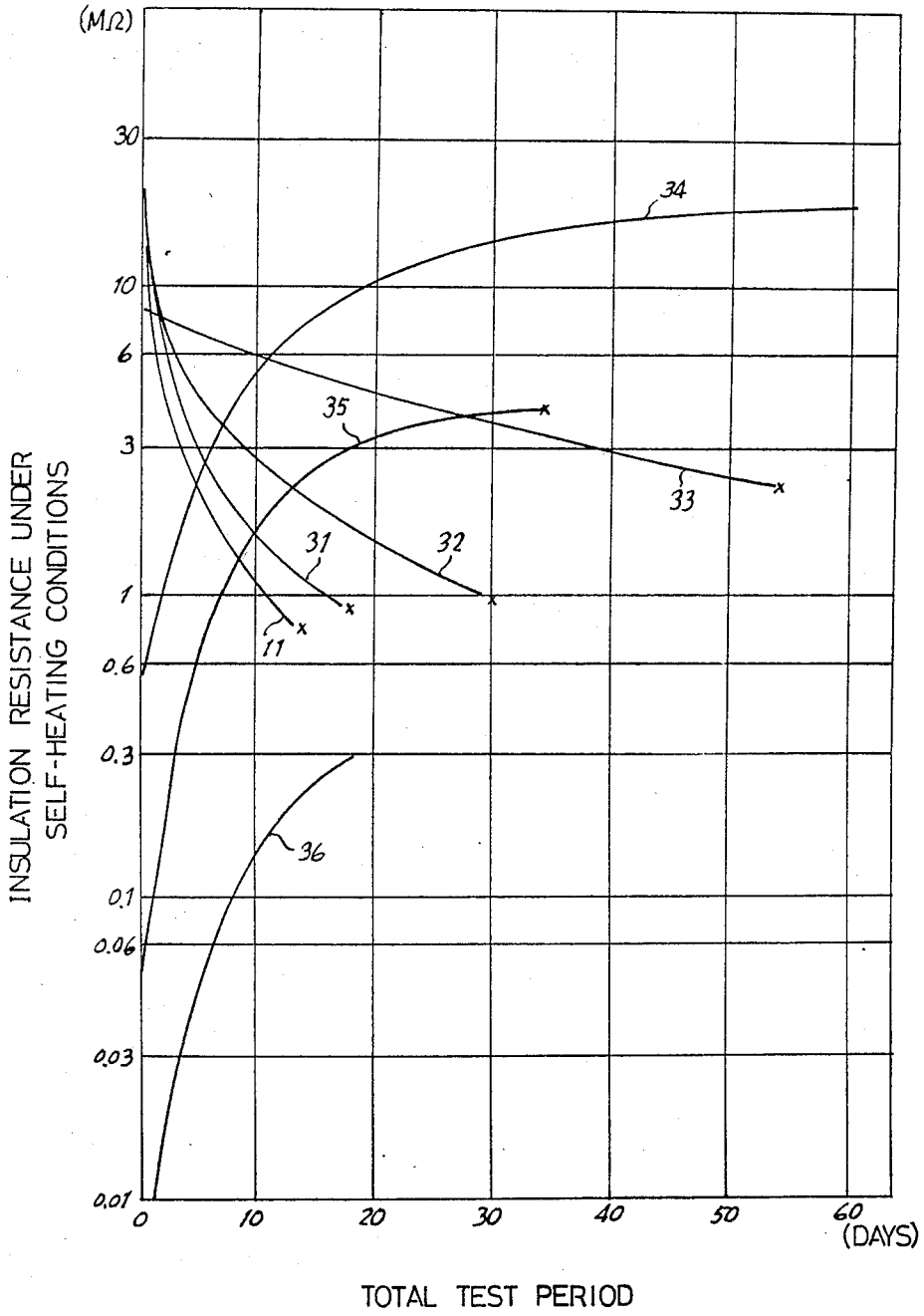
Figure 12:
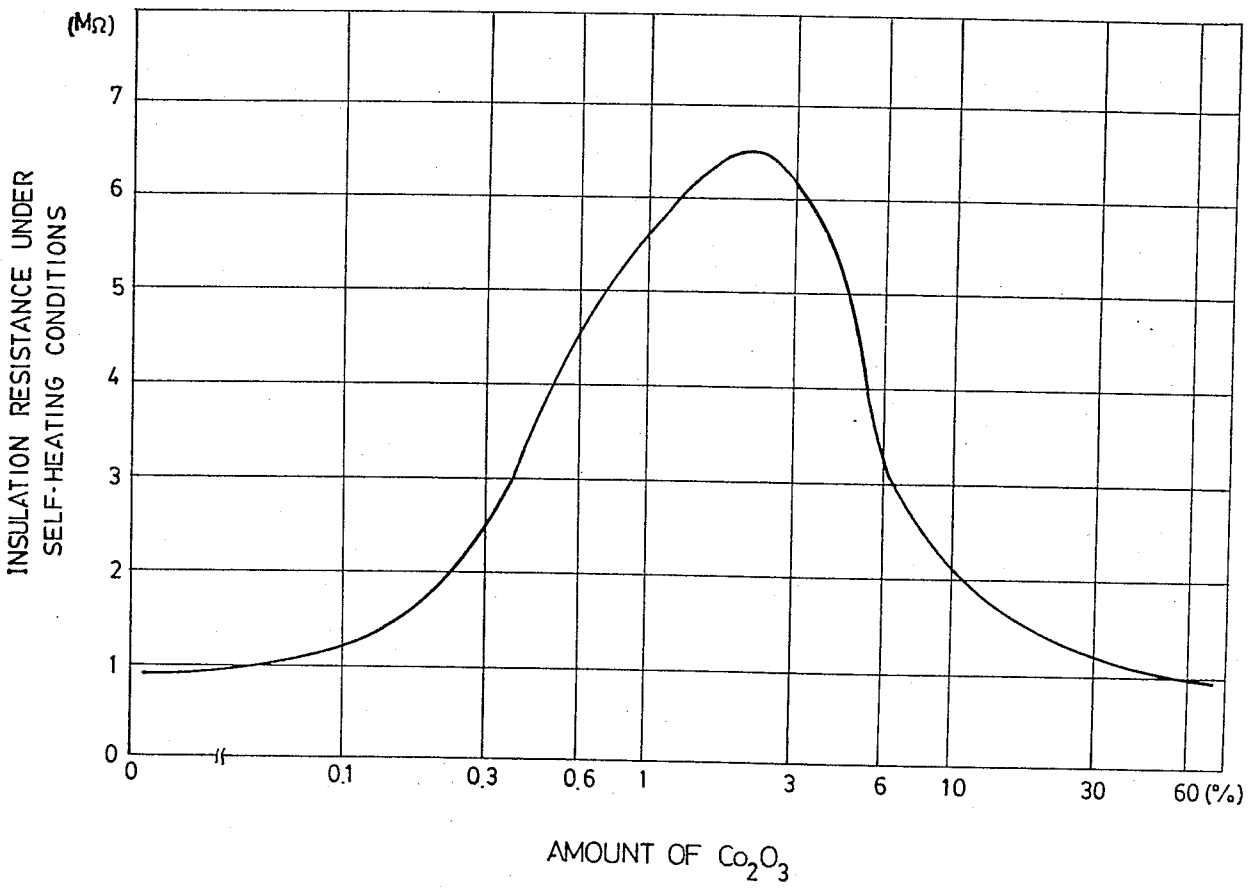
Figure 13:
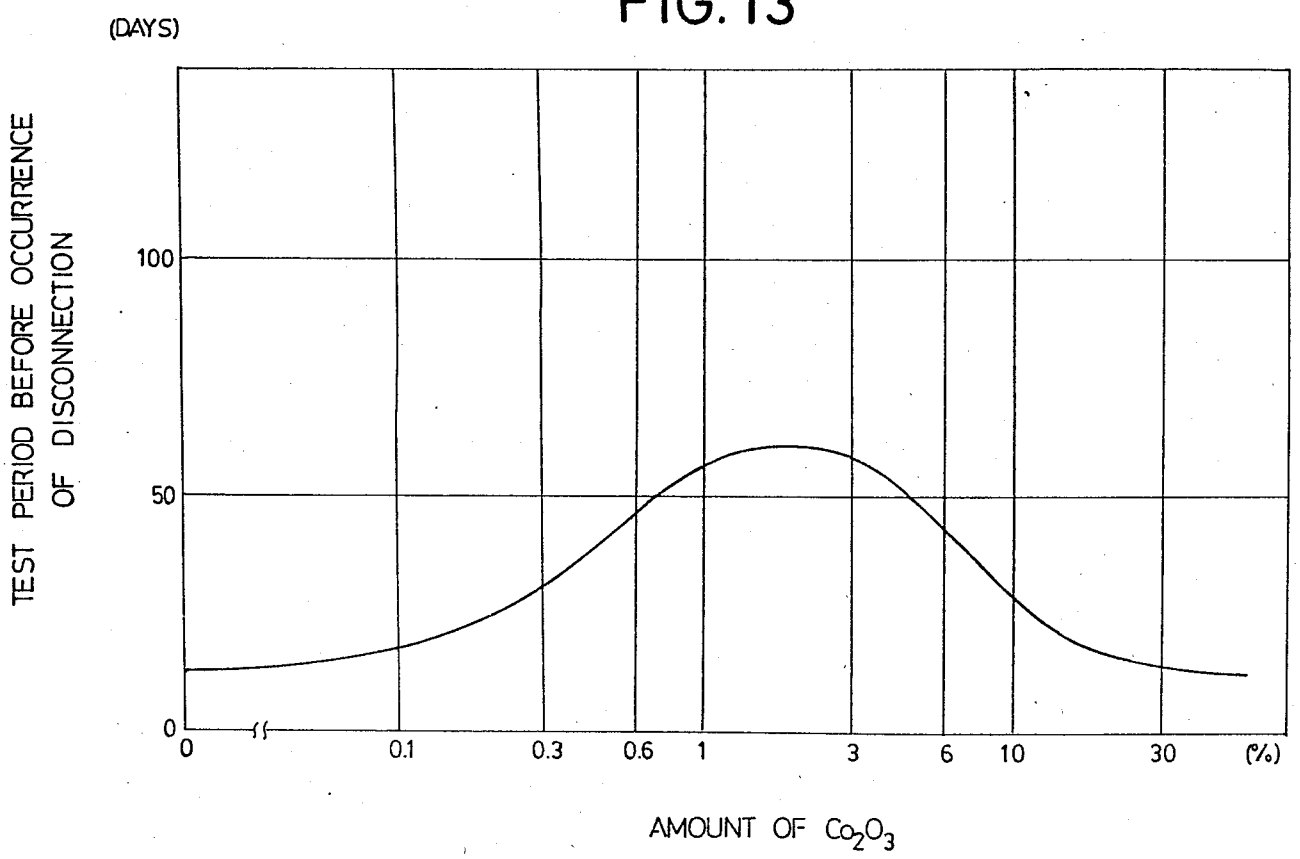

FIG. 11 shows the variation of insulation resistance under self-heating conditions as a function of time, FIG. 12 shows the relation between the content of $Co_2O_3$ and the insulation resistance under self-heating conditions as measured 11 days after commencement of the test, and FIG. 13 shows relation between the content of $Co_2O_3$ and the life.

It will be noted that in FIG. 11, curves 31–36 correspond to the sheathed resistance heaters of sample Nos. 31–36, respectively.

TABLE 5

| Sample No. | Content of $Co_2O_3$ (wt %) | Initial Insulation Resistance under Self-Heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 31 | 0.1 | 15 | 1.4 | 18 |
| 32 | 0.3 | 10 | 2.5 | 30 |
| 33 | 1.0 | 8.4 | 5.6 | 54 |
| 34 | 3.0 | 0.5 | 6.2 | 60 |
| 35 | 10.0 | 0.06 | 2.0 | 34 |
| 36 | 30.0 | <0.01 | 0.17 | 18 |

As will be apparent from the results of Table 5 and FIG. 11, the sheathed resistance heaters of sample Nos. 31–35 in which electrically insulating powders containing $Co_2O_3$ in amounts ranging from 0.1–10 wt% were used exhibited a less lowering of the insulation resistance values under self-heating conditions than the sheathed resistance heater of sample No. 36 and were thus good. The sheathed electric heater of sample number 36 was so low in insulation resistance under self-heating conditions that it could not be used for practical applications.

As will be clearly seen from FIG. 12, the sheathed heaters in which the content of $Co_2O_3$ was in the range of 0.1–10 wt% exhibited higher insulation resistance values under self-heating conditions as measured 11 days after commencement of the continuous test than the conventional sheathed heater numbered as 11.

Moreover, the results of FIG. 13 reveal that the sheathed heaters in which the content of $Co_2O_3$ is in the range of 0.1–10 wt% are longer in life than the conventional sheathed heater of sample No. 11.

Thus, the sheathed resistance heaters which made use of electrically insulating powders 4 containing $Co_2O_3$ in amounts ranging from 0.1–10 wt% were found to have a less lowering of the insulation resistance under self-heating conditions and a longer life.

[EXAMPLE 5]

An electrofused magnesia powder was used as a main component of the electrically insulating powder 4 and admixed with $Co_3O_4$ in different amounts to obtain several samples of electrically insulating powder 4.

Subsequently, the general procedure of Example 1 was repeated to obtain sheathed heaters of sample Nos. 37–42.

These sheathed heaters were subjected to the measurement of the initial insulation resistance under self-heating conditions, variation of the insulation resistance under self-heating conditions in relation to time, and life.

Among the results of the measurement, the initial insulation resistance under self-heating conditions, insulation resistance under self-heating conditions as measured 11 days after commencement of the continuous test, and life are shown in Table 6.

Figure 14:
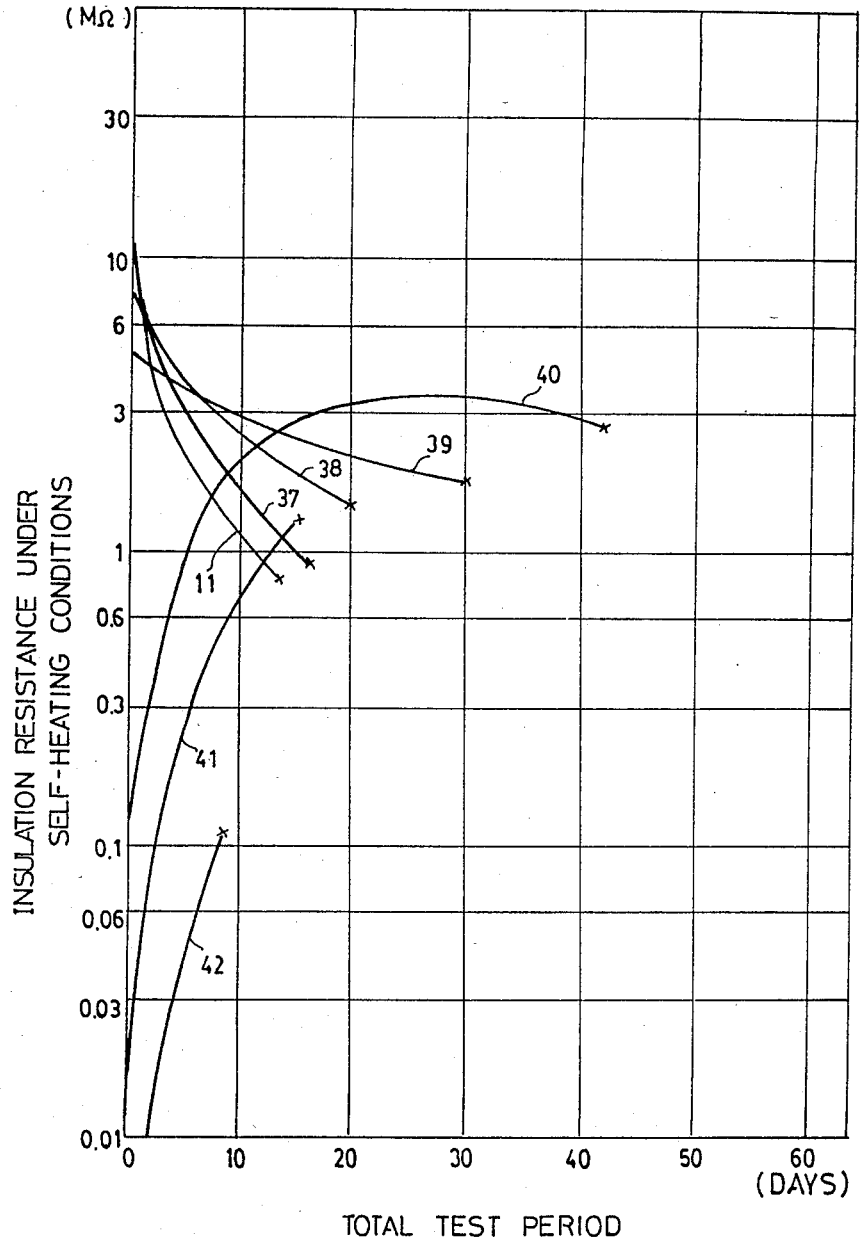
Figure 15:
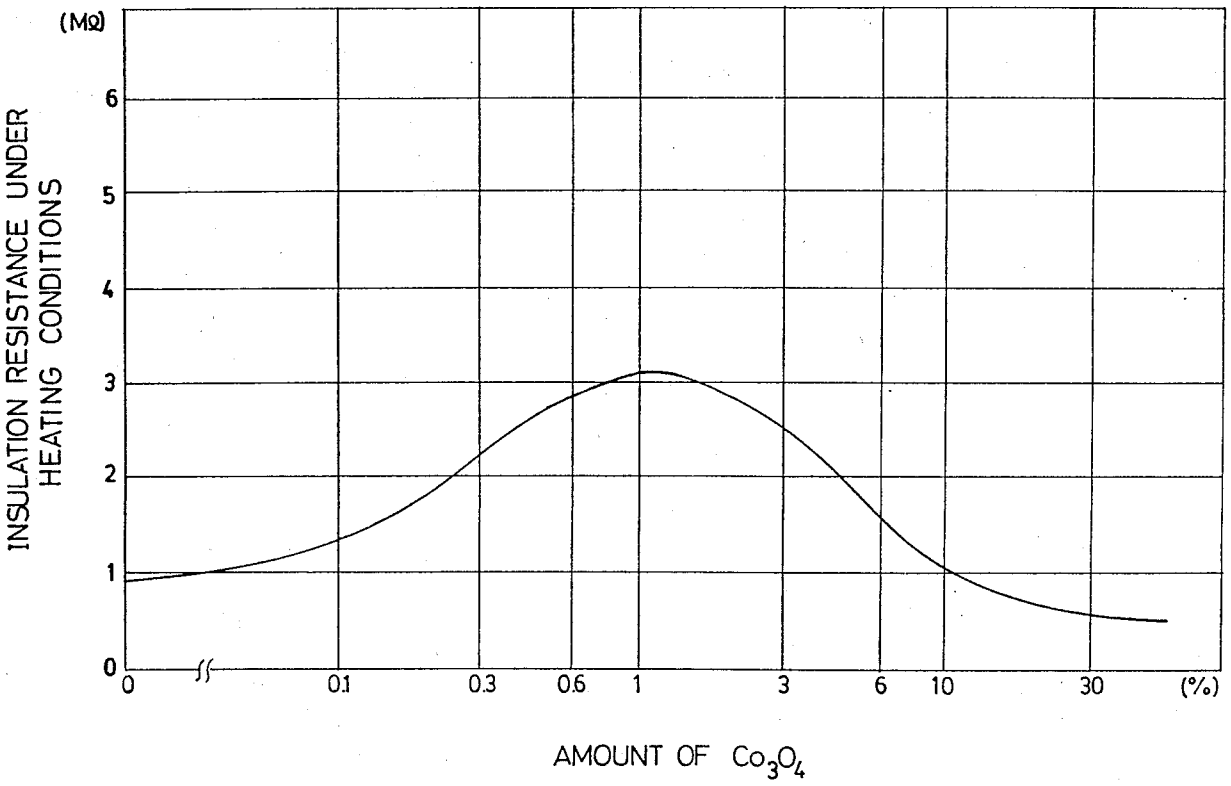

FIG. 14 shows the variation of the insulation resistance under self-heating conditions in relation to time and FIG. 15 shows the relation between the content of $Co_3O_4$ and the insulation resistance under self-heating conditions as measured after 11 days. FIG. 14 shows the relation between the content of $Co_3O_4$ and the life.

In FIG. 14, curves 37–42 correspond to the sheathed heaters of sample Nos. 37–42, respectively.

TABLE 6

| Sample No. | Content of $Co_3O_4$ (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 1 | 0.0 | 20 | 0.95 | 13 |
| 37 | 0.1 | 14 | 1.3 | 16 |
| 38 | 0.3 | 8 | 2.3 | 19 |
| 39 | 1.0 | 4.8 | 3.1 | 29 |
| 40 | 3.0 | 0.1 | 2.5 | 41 |
| 41 | 10.0 | 0.01 | 1.0 | 15 |
| 42 | 30.0 | <0.01 | — | 9 |

As will be apparent from the results of Table 6 and FIG. 14, the sheathed resistance heaters of sample Nos. 37–41 in which there were used electrically insulating powders containing $Co_3O_4$ in amounts ranging from 0.1–10 wt% had a less lowering of the insulation resistance under self-heating conditions than the sheathed heater numbered as 11 and were thus good. The sheathed heater of sample No. 42 was low in the initial insulation resistance under self-heating conditions and could not be used for practical purposes.

FIG. 15 reveals that the sheathed heaters in which the content of $Co_3O_4$ was in the range of 0.1–10 wt% exhibited higher insulation resistance values under self-heating conditions as measured 11 days after commencement of the continuous test than the conventional sheathed heater of sample No. 11.

Figure 16:
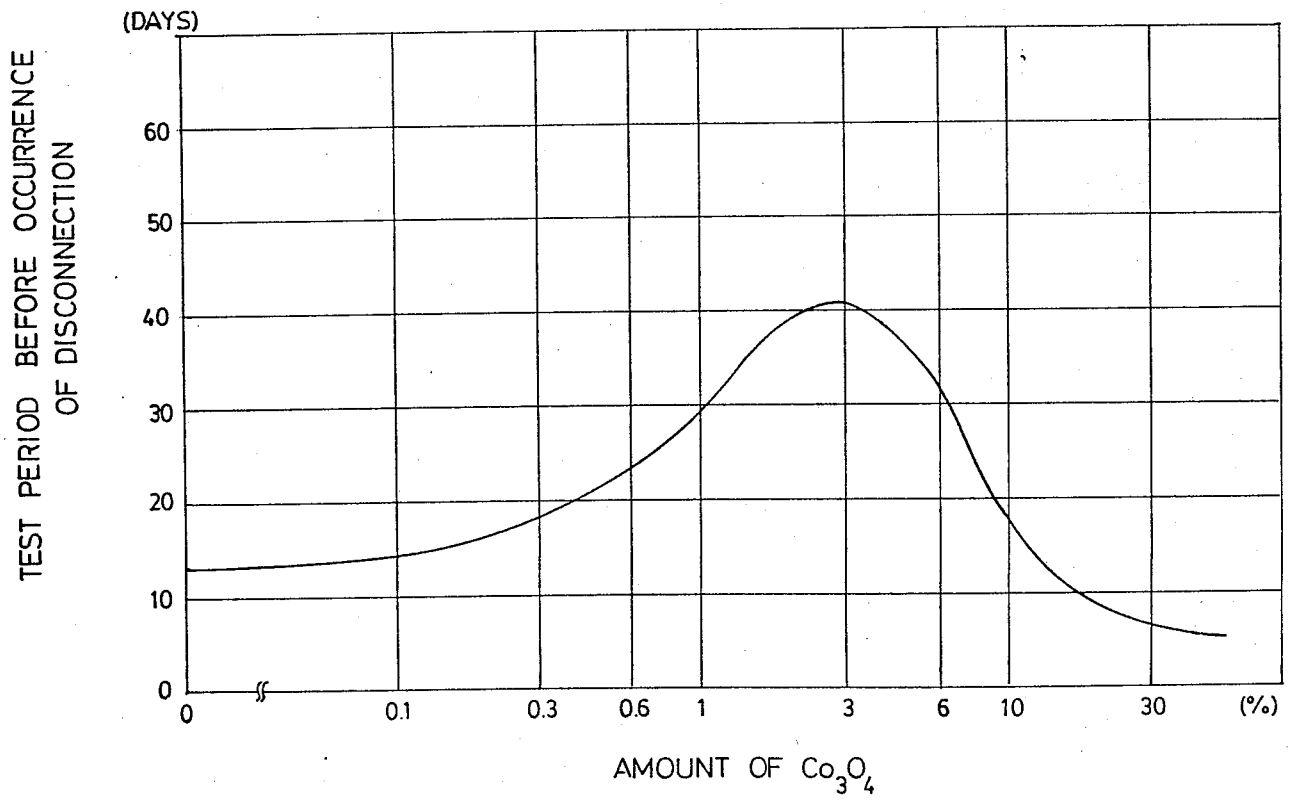

As will also be apparent from FIG. 16, the sheathed heaters in which the content of $Co_3O_4$ was in the range of 0.1–10 wt% were slightly longer in life than the conventional sheathed heater of sample No. 11.

Thus, the sheathed resistance heaters which made use of electrically insulating powders 4 containing $Co_3O_4$ in amounts of 0.1–10 wt% had a less lowering of the insulation resistance under self-heating conditions and a longer life.

[EXAMPLE 6]

An electrofused magnesia powder was used as a main component of the electrically insulating powder 4 and admixed with $Fe_2O_3$ in different amounts to obtain several samples of electrically insulating powder 4.

Thereafter, the general procedure of Example 1 was repeated thereby obtaining sheathed resistance heaters of sample Nos. 43–48.

These sheathed heaters were each subjected to the measurement of the initial insulation resistance under self-heating conditions, variation of the insulation resistance under self-heating conditions in relation to time, and life.

Among the results of the measurement, there are shown in Table 7 the initial insulation resistance under self-heating conditions, insulation resistance under self-heating conditions measured 11 days after commencement of the continuous test, and life.

Figure 17:
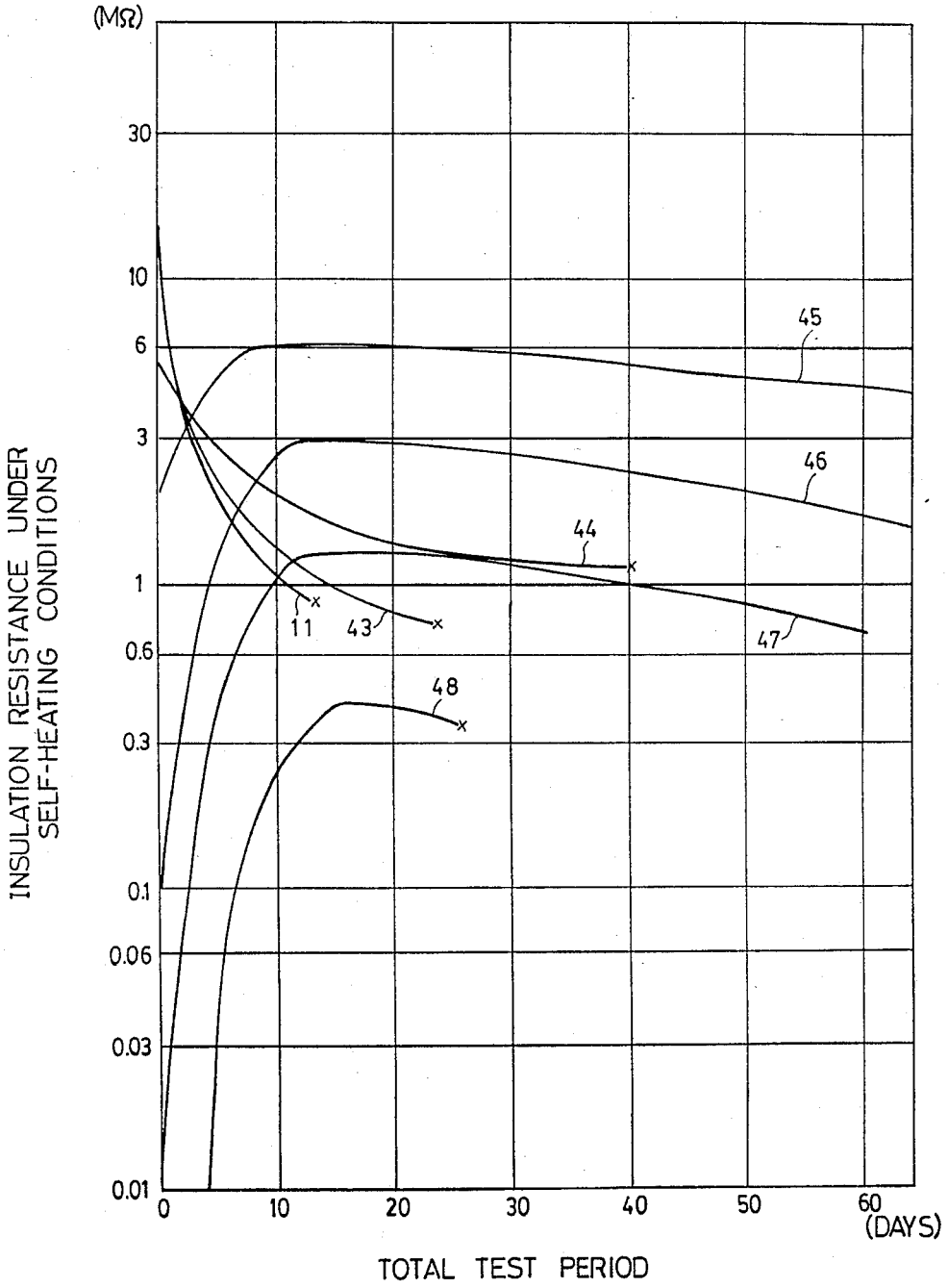
Figure 18:
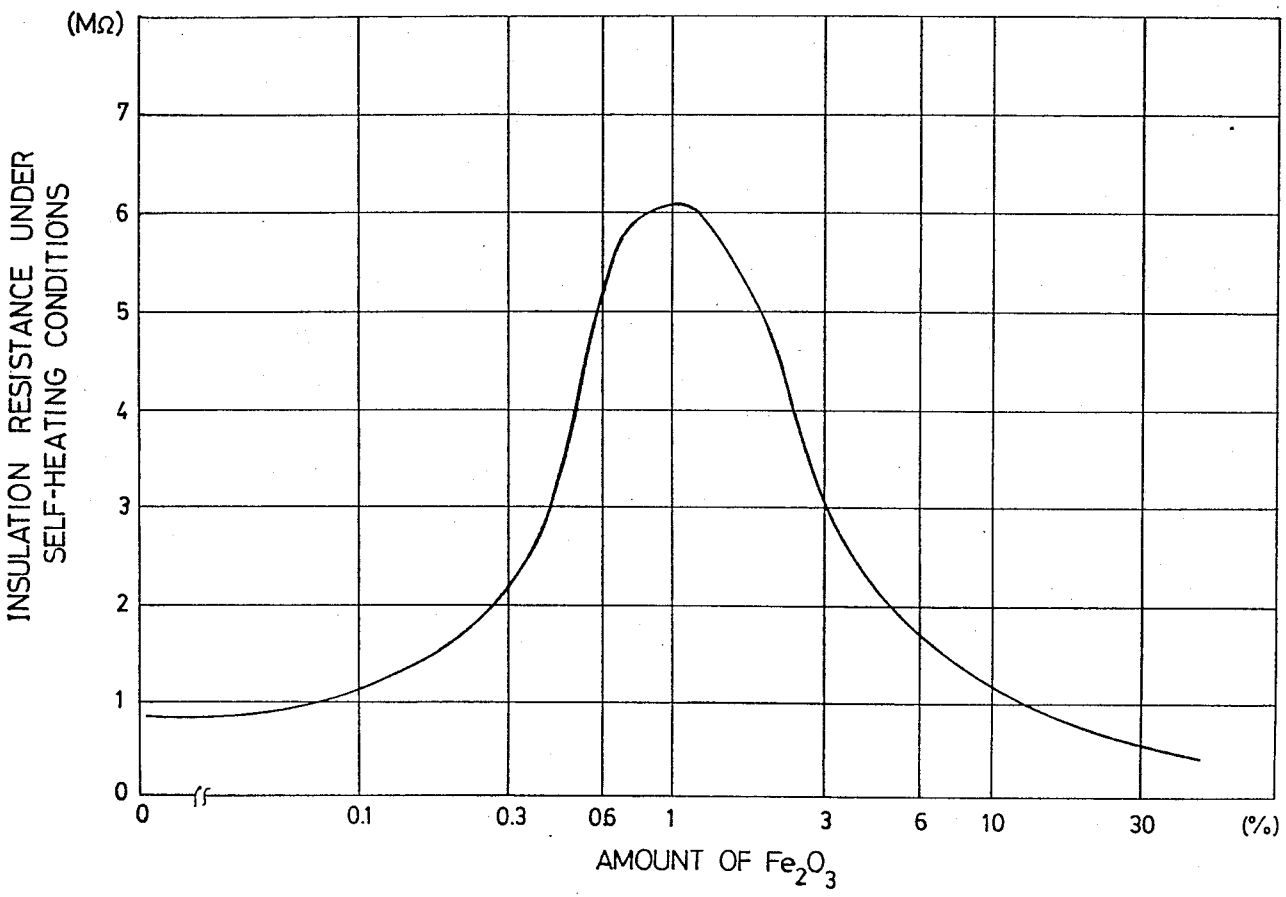
Figure 19:
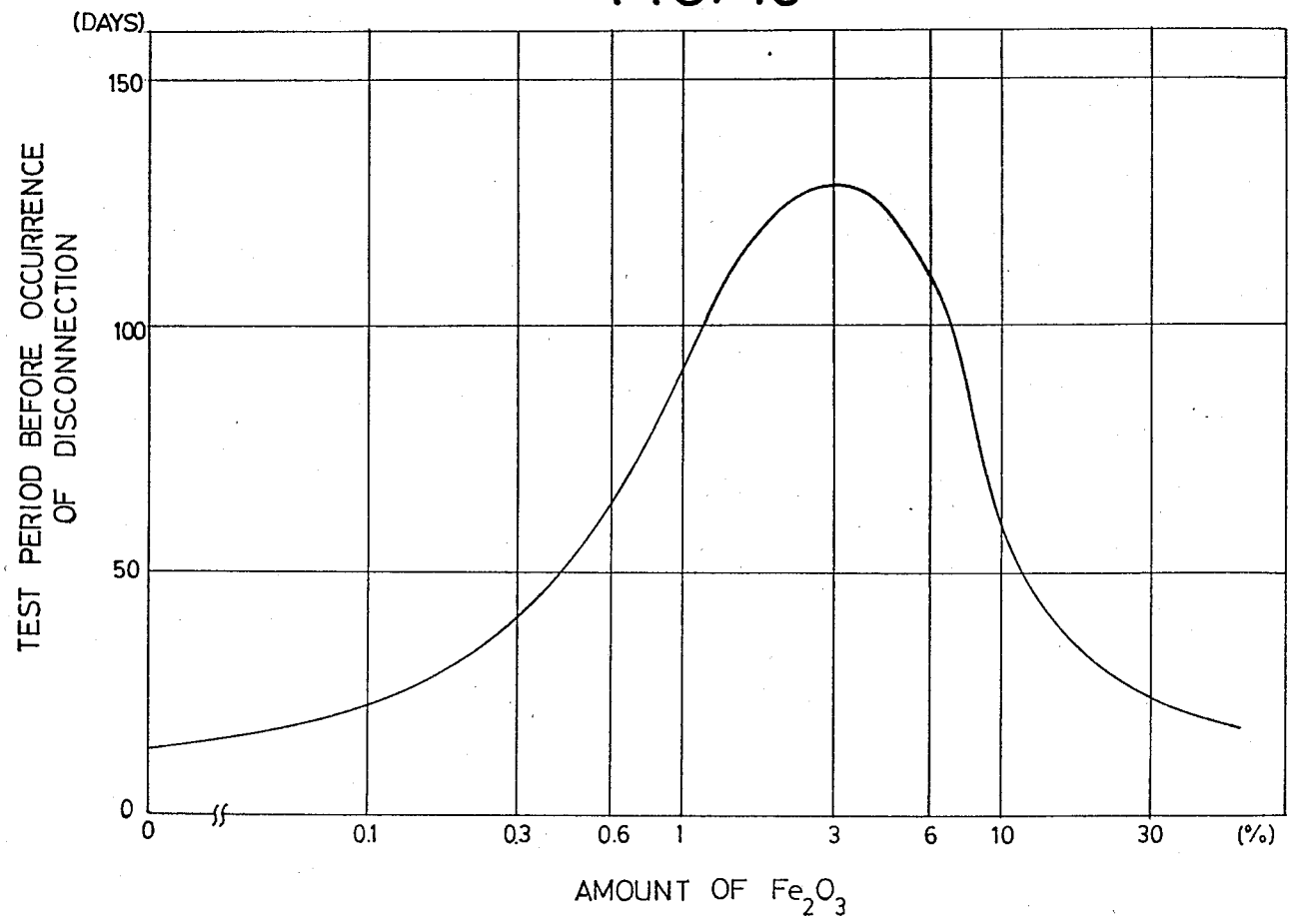

FIG. 17 shows the variation of the insulation resistance under self-heating conditions in relation to time, FIG. 18 shows the relation between the content of $Fe_2O_3$ and the insulation resistance under self-heating conditions measured after 11 days, an FIG. 19 shows the relation between the content of $Fe_2O_3$ and the life.

In FIG. 17, curves 43–48 correspond to the sheathed heaters of sample Nos. 43–48, respectively.

TABLE 7

| Sample No. | Content of $Fe_2O_3$ (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 43 | 0.1 | 10 | 1.2 | 23 |
| 44 | 0.3 | 5.1 | 1.8 | 40 |
| 45 | 1.0 | 1.8 | 6.0 | 90 |
| 46 | 3.0 | 0.08 | 2.8 | 128 |
| 47 | 10.0 | 0.01 | 1.2 | 60 |
| 48 | 30.0 | <0.01 | 0.28 | 25 |

As will be apparent from the results of Table 7 and FIG. 17, the sheathed resistance heaters of sample Nos. 43–47 in which there were used electrically insulating powders containing $Fe_2O_3$ in amounts of 0.1–10 wt% were found to have a less lowering of the insulation resistance under self-heating conditions than the known sheathed heater of sample No. 11 and were thus good. The sheathed resistance heater of sample No. 48 was so low in initial insulation resistance under self-heating conditions that it could not be used for practical applications.

As will be clearly seen from FIG. 18, the sheathed heaters in which the content of $Fe_2O_3$ was in the range of 0.1–10 wt% exhibited high insulation resistance values under self-heating conditions measured 11 days after commencement of the continuous energizing test than the conventional sheathed heater of sample No. 11.

The results of FIG. 19 demonstrate that the sheathed resistance heaters in which the content of $Fe_2O_3$ was in the range of 0.1–10 wt% were longer in life than the sheathed heater of sample No. 11.

Thus, the sheathed resistance heaters which made use of electrically insulating powders containing $Fe_2O_3$ in amount of 0.1–10 wt% were found to have a less lowering of the insulation resistance under self-heating conditions and a longer life.

[EXAMPLE 7]

An electrofused magnesia powder was used as a main component of the electrically insulating powder 4 and admixed with $Fe_3O_4$ in different amounts to obtain several samples of electrically insulating powder 4.

Thereafter, the general procedure of Example 1 was repeated thereby obtaining sheathed resistance heaters of sample Nos. 49–54.

These sheathed heaters were each subjected to the measurement of the initial insulation resistance under self-heating conditions, variation of the insulation resistance under self-heating conditions in relation to time, and life.

Among the results of the measurement, there are shown in Table 8 the initial insulation resistance under self-heating conditions, insulation resistance under self-heating conditions after 11 days, and life.

Figure 20:
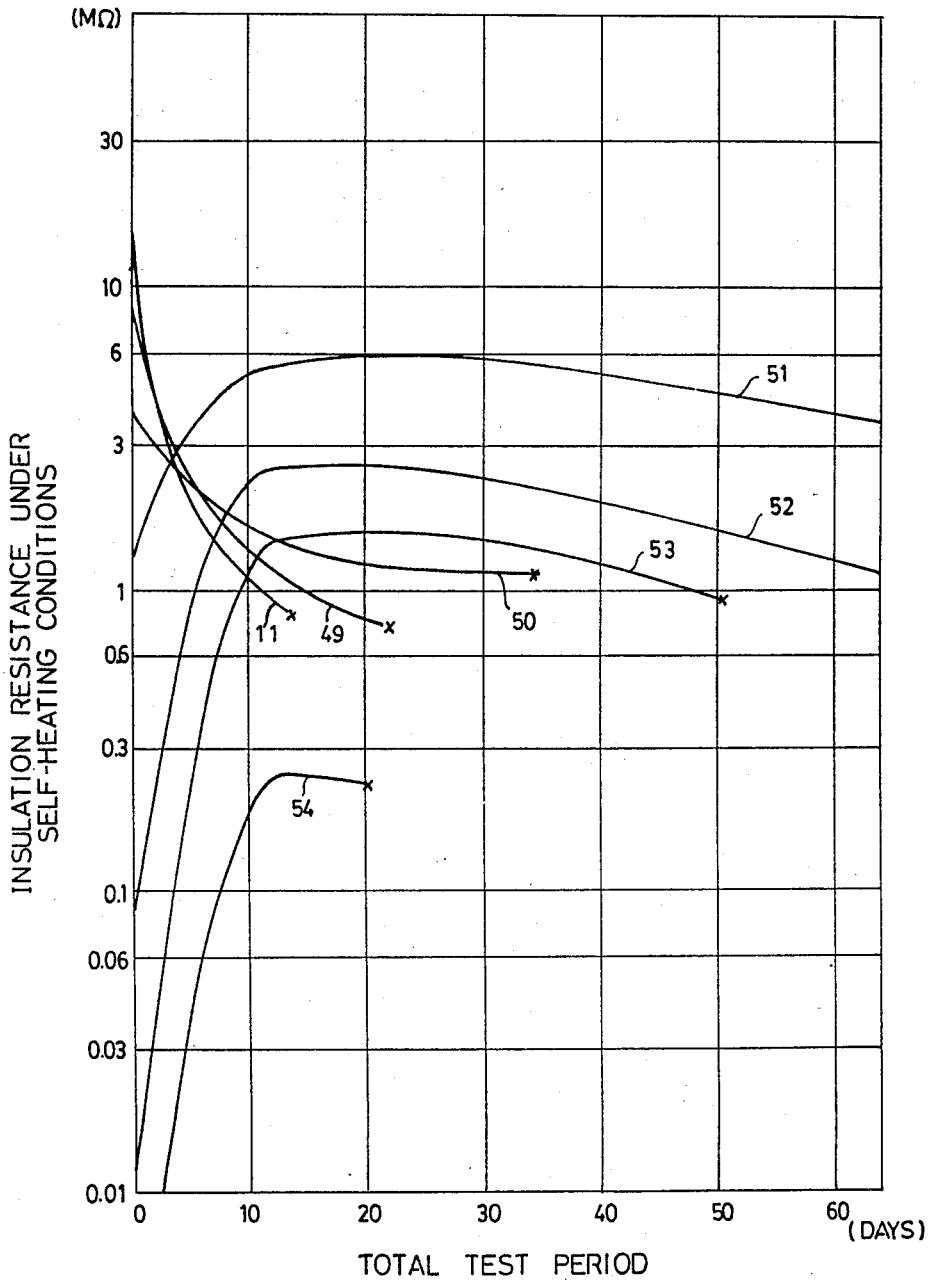
Figure 21:
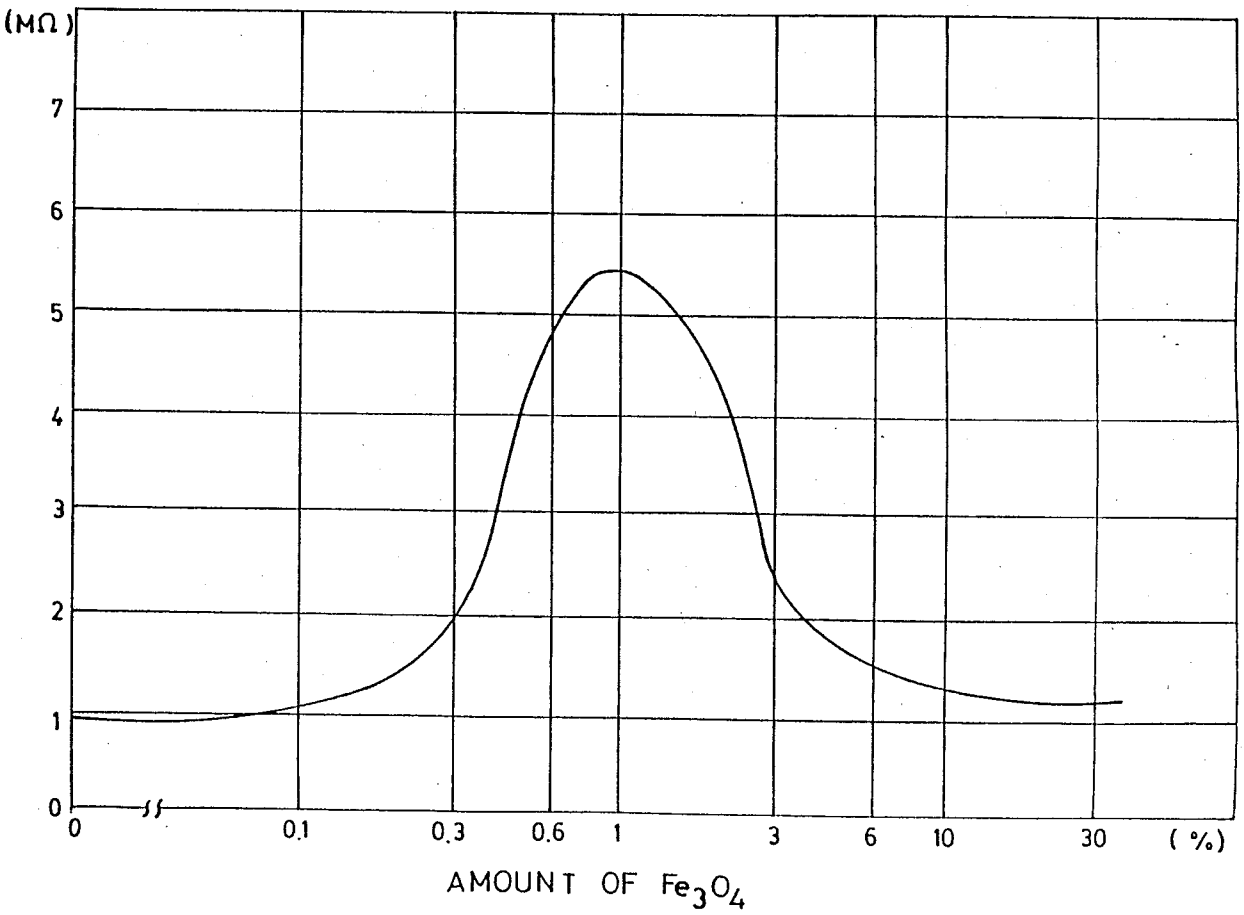
Figure 22:
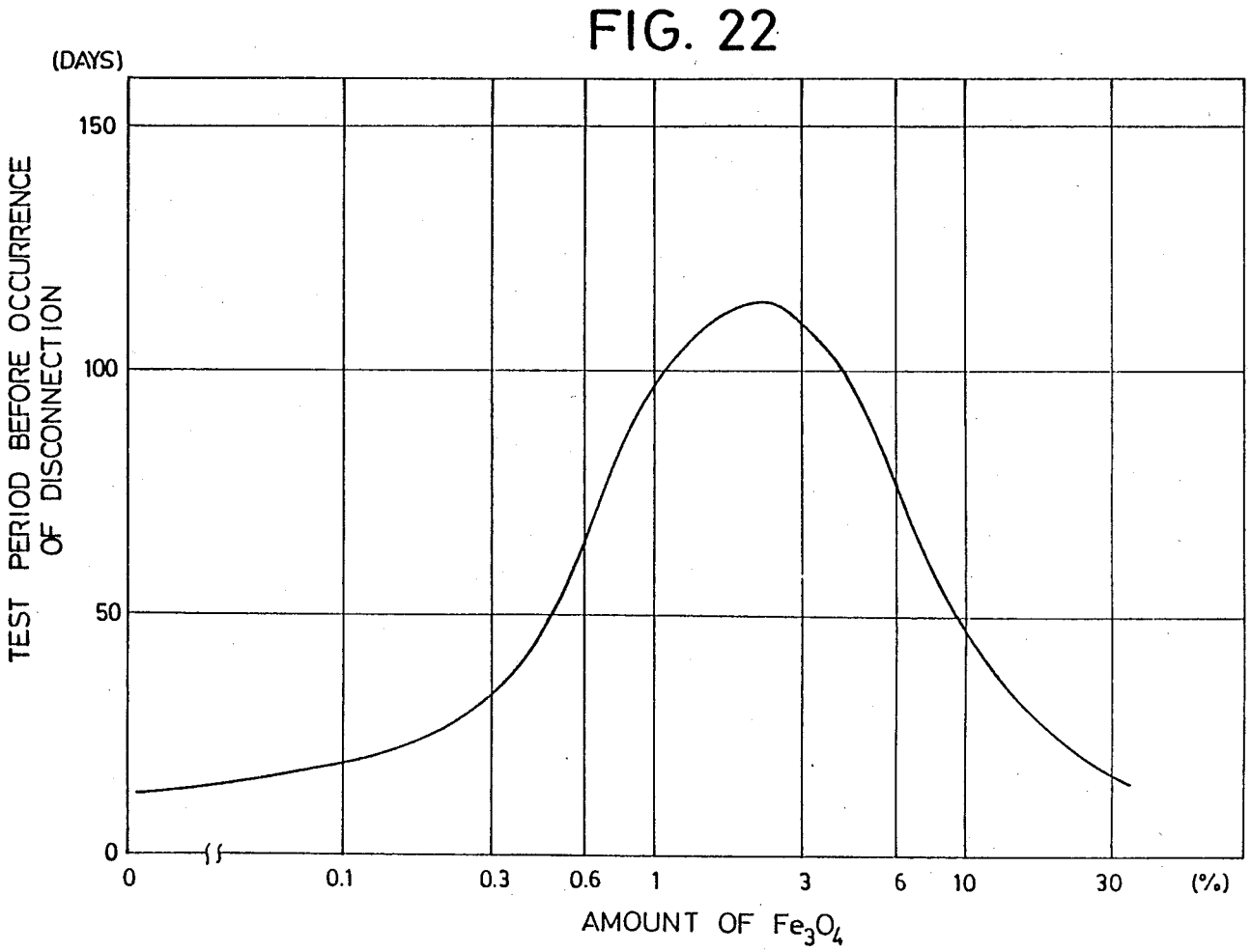

FIG. 20 shows the variation of the insulation resistance under self-heating conditions in relation to time, FIG. 21 shows the relation between the content of $Fe_3O_4$ and the insulation resistance under self-heating conditions after 11 days, and FIG. 22 shows the relation between the content of $Fe_3O_4$ and the life.

In FIG. 20, curves 49–54 correspond to the sheathed heaters of sample Nos. 49–54, respectively.

TABLE 8

| Sample No. | Content of $Fe_3O_4$ (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 49 | 0.1 | 8.0 | 1.2 | 22 |
| 50 | 0.3 | 3.8 | 1.5 | 34 |
| 51 | 1.0 | 1.2 | 5.4 | 96 |
| 52 | 3.0 | 0.08 | 2.5 | 115 |
| 53 | 10.0 | 0.01 | 1.4 | 50 |
| 54 | 30.0 | <0.01 | 0.22 | 21 |

As will be apparent from the results of Table 8 and FIG. 20, the sheathed resistance heaters of sample Nos. 49–53 in which electrically insulating powders containing 0.1–10 wt% of $Fe_3O_4$ were used had a less lowering of the insulation resistance under self-heating conditions than the known sheathed heater of sample No. 11 and were thus good. The sheathed resistance heater of sample No. 54 is so low in initial insulation resistance under self-heating conditions that it cannot be used for practical applications.

The results of FIG. 21 reveal that the sheathed heaters in which the content of $Fe_3O_4$ is in the range of 0.1–10 wt% had higher insulation resistance values under self-heating conditions as measured 11 days after commencement of the continuous energizing test than the known sheathed heater of sample No. 11.

Also, FIG. 22 reveals that the sheathed heaters in which the content of $Fe_3O_4$ was in the range of 0.1–10 wt% had a longer life than the conventional sheathed heater of sample No. 11.

Thus, the sheathed resistance heaters which made use of electrically insulating powders containing 0.1–10 wt% of $Fe_3O_4$ had a less lowering of the insulation resistance heater under self-heating conditions and longer life.

[EXAMPLE 8]

An electrofused magnesia powder was used as a main component of the electrically insulating powder 4 and admixed with $Fe_2O_3$ and $Fe_3O_4$ in different amounts to obtain several samples of electrically insulating powder 4. It will be noted that $Fe_2O_3$ and $Fe_3O_4$ were used in equal amounts.

Thereafter, Example 1 was repeated thereby obtaining sheathed resistance heaters of Example Nos. 55–60.

These sheathed heaters were subjected to the measurement of the initial insulation resistance under self-heating conditions, variation of the insulation resistance under self-heating conditions, and life.

Among the results of the measurement, there are shown in Table 9 the initial insulation resistance under self-heating conditions, insulation resistance under self-heating conditions as measured 11 days after commencement of the continuous test, and life.

Figure 23:
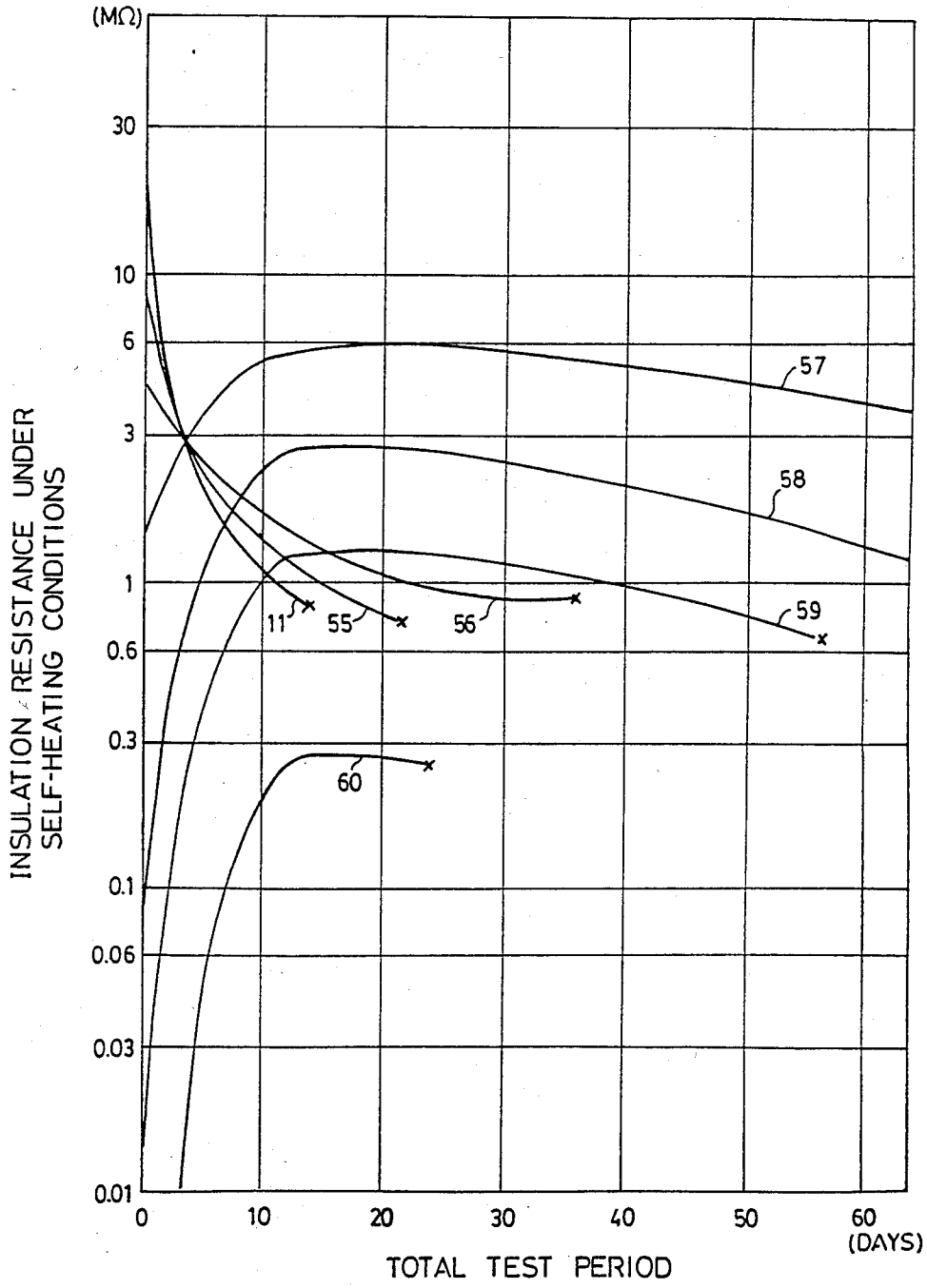
Figure 24:
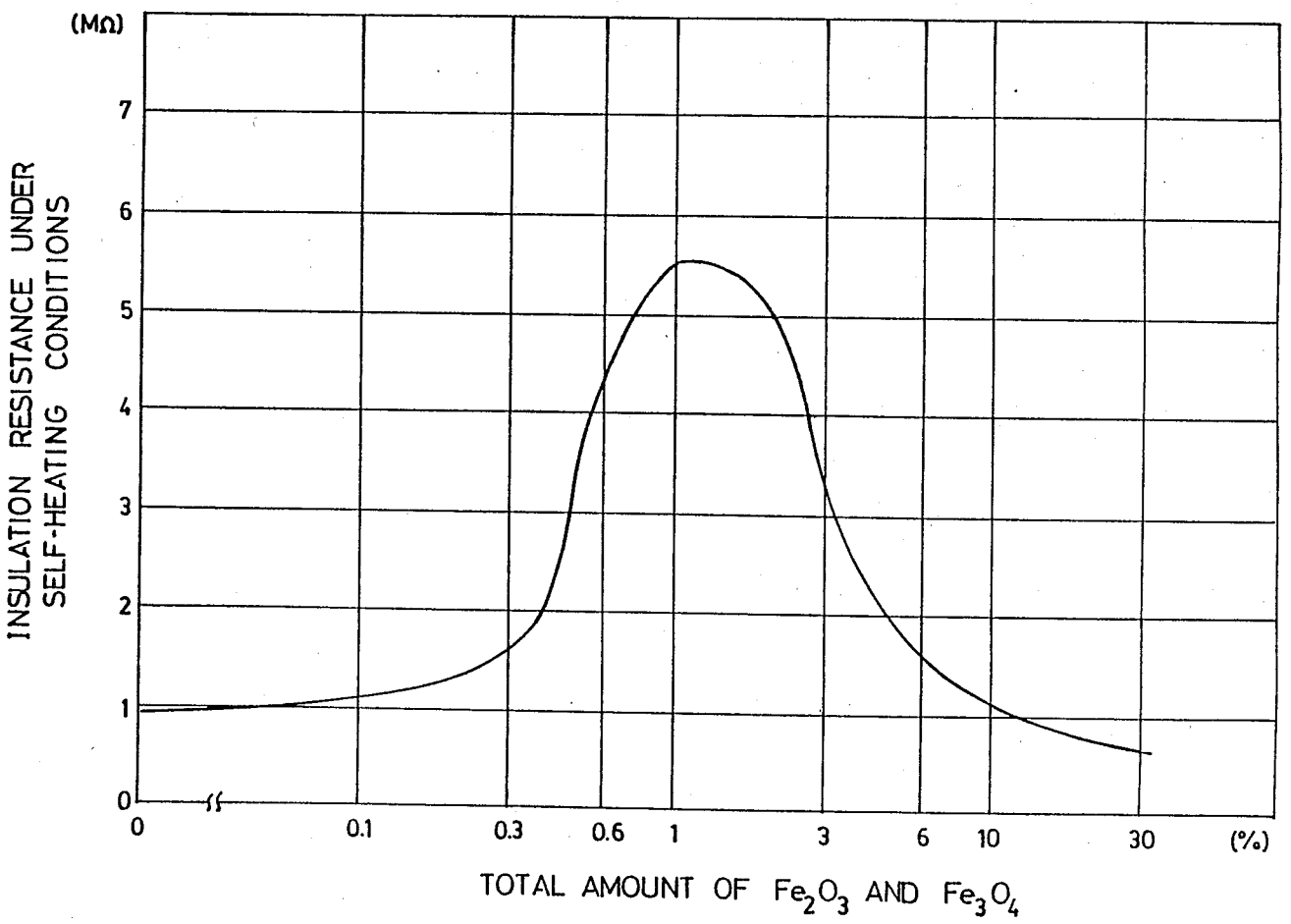
Figure 25:
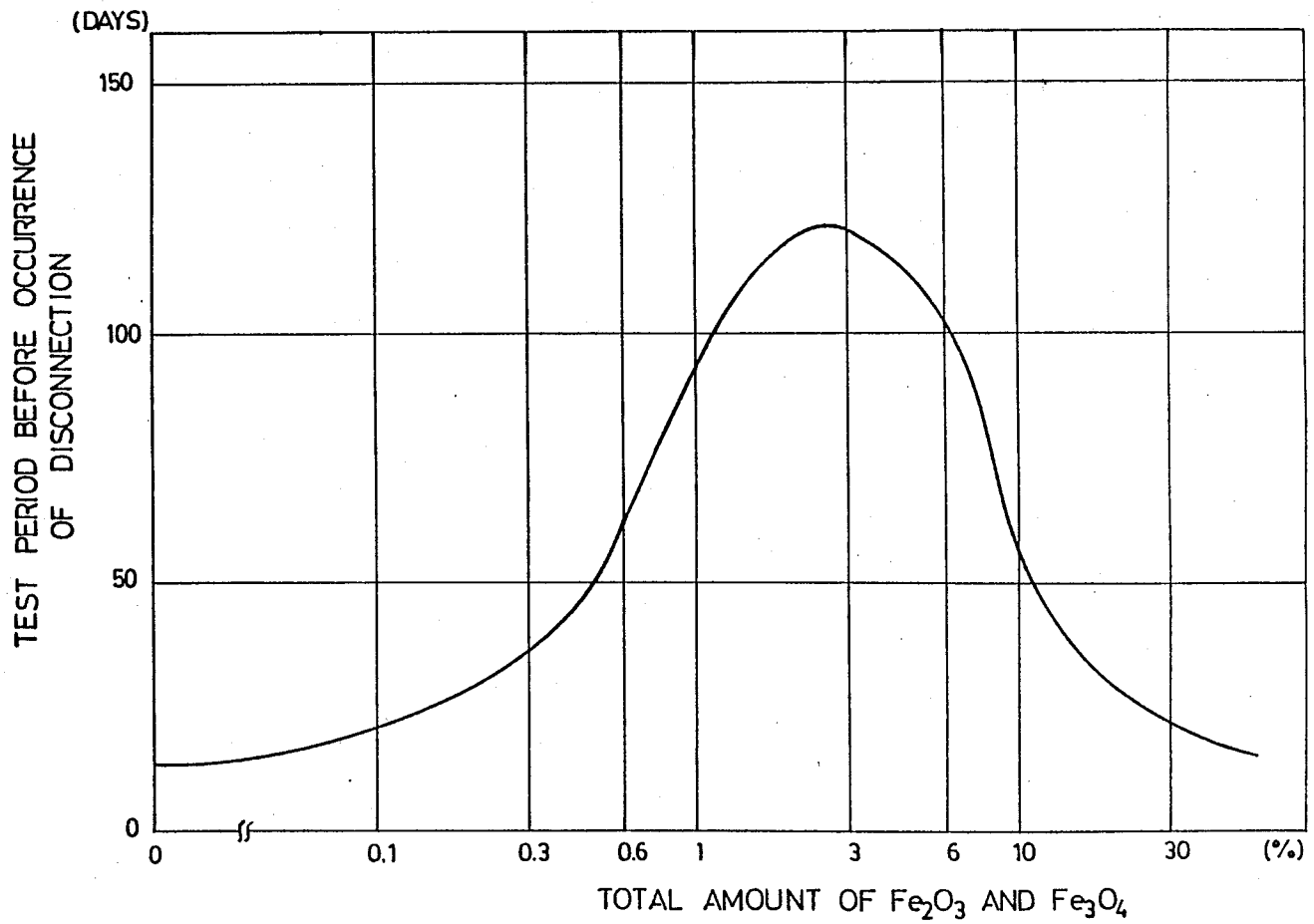

FIG. 23 shows the variation of the insulation resistance under self-heating conditions in relation to time, FIG. 24 shows the relation between the total amount of $Fe_2O_3$ and $Fe_3O_4$ and the insulation resistance under self-heating conditions after 11 days, and FIG. 25 shows the relation between the total amount of $Fe_2O_3$ and $Fe_3O_4$ and the life.

In FIG. 24, curves 55–60 correspond to the sheathed resistance heaters of sample Nos. 55–60, respectively.

TABLE 9

| Sample | Total Content of $F_2O_3$ & $Fe_3O_4$ (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 1 | 0.0 | 20 | 0.95 | 13 |
| 55 | 0.1 | 9 | 1.2 | 22 |
| 56 | 0.3 | 4.4 | 1.5 | 36 |
| 57 | 1.0 | 1.5 | 5.5 | 93 |
| 58 | 3.0 | 0.08 | 2.6 | 120 |
| 59 | 10.0 | 0.01 | 1.2 | 56 |
| 60 | 30.0 | <0.01 | 0.26 | 24 |

As will become apparent from Table 9 and FIG. 23, the sheathed resistance heaters of sample Nos. 55–59 in which there were used electrically insulating powders containing 0.1–10 wt% of $Fe_2O_3$ and $Fe_3O_4$ in total amounts exhibited a less lowering of the insulation resistance under self-heating conditions than the conventional sheathed resistance heater of sample No. 11. The sheathed heater of sample No. 60 was so low in the initial insulation resistance under self-heating conditions that it could not be used for practical applications.

As will become apparent from FIG. 24, the sheathed resistance heaters which made use of electrically insulating powders containing 0.1–10 wt% of $Fe_2O_3$ and $Fe_3O_4$ in total exhibited higher insulation resistance values under self-heating conditions as measured 11 days after commencement of the continuous energizing test than the sheathed heater of sample No. 11.

Further, FIG. 25 demonstrates that the sheathed heaters in which the total content of $Fe_2O_3$ and $Fe_3O_4$ was in the range of 0.1–10 wt% had a longer life than the known sheathed heater.

Thus, the sheathed resistance heaters which made use of electrically insulating powders 4 containing 0.1–10 wt% of $Fe_2O_3$ and $Fe_3O_4$ in total amounts had a less lowering of the insulation resistance under self-heating conditions and a longer life.

It should be noted that although a certain kind of electrofused magnesia powder has been known to contain $Fe_2O_3$ and $Fe_3O_4$ impurities in large amounts, a sheathed resistance heater which comprises the impurity-containing electrofused magnesia as the electrically insulating powder was found to be low in insulation resistance. Accordingly, this heater could not be used for high temperature purposes. In this sense, the impurity-containing magnesia powder is considered to differ from the electrically insulating powder admixed with $Fe_2O_3$ and $Fe_3O_4$ used in the practice of the present invention.

In the above-described Examples, oxides such as NiO, CoO, $Co_2O_3$, $Co_3O_4$, $Fe_2O_3$ and $Fe_3O_4$ are used, and similar results are obtained when there are used other oxides such as $WO_3$, CuO, $Ga_2O_3$, $SnO_2$ and ZnO.

Moreover, the electrofused magnesia powder was used as a main component of the electrically insulating powder in Examples 1–8. A similar tendency results when using, instead of the electrofused magnesia powder, electrofused alumina and silica powders.

The characteristics of sheathed heater may vary depending on the type of an electrofused magnesia powder. For instance, when an electrofused magnesia powder having a high specific resistance is used, there can be obtained a sheathed resistance heater of higher insulation resistance. Use of a highly pure electrofused magnesia powder having a relatively long life results in a sheathed resistance heater of longer life.

The nichrome wire of the first kind used as the heating wire 2 may be replaced by several wires indicated in Table 10 with similar results. As regards the metal pipe 3, similar results are obtained when using metallic materials indicated in Table 11.

TABLE 10

| Kind | | Chemical Composition (%) | | | | | | |
|---|---|---|---|---|---|---|---|---|
| | | C | Cr | C | Si | Mn | Fe | Al |
| Nichrome Wire | First Kind | over 77 | 19–21 | below 0.15 | 0.75–1.5 | below 2.5 | below 1 | — |
| | Second Kind | over 57 | 15–18 | below 0.15 | 0.75–1.5 | below 1.5 | balance | — |
| Iron-Chromium-Aluminum | First Kind | — | 23–26 | below 0.10 | below 1.5 | below 1.0 | " | 4–6 |
| | Second Kind | — | 17–21 | below | below | below | " | 2–4 |

TABLE 11

| Kind | | Chemical Composition | | | | | | | | | |
|---|---|---|---|---|---|---|---|---|---|---|---|
| | | C | Si | Mn | P | S | Ni | Cr | Fe | Cu | Al |
| Stainless Steel | SUS304 | below 0.08 | below 1.00 | below 2.00 | below 0.04 | below 0.03 | 8.00–10.50 | 18.00–20.00 | balance | — | — |
| | SUS321 | below 0.08 | below 1.00 | below 2.00 | below 0.04 | below 0.03 | 9.00–13.00 | 17.00–19.00 | balance | — | — |
| | SUS316L | below 0.03 | below 1.00 | below 2.00 | below 0.04 | below 0.03 | 12.00–15.00 | 16.00–18.00 | balance | — | — |
| Corrosion & Heat Resistant Super Alloy | NCF 1P (Inconeru 600) | below 0.15 | below 0.50 | below 1.00 | below 0.030 | below 0.015 | over 72.00 | 14.00–17.00 | 6.00–10.00 | below 0.50 | — |
| | NCF 2P (Incoroi 800) | below 0.10 | below 1.00 | below 1.50 | below 0.030 | below 0.015 | 30.00–35.00 | 19.00–23.00 | balance | below 0.75 | 0.15–0.60 |

The metal tubes were sealed with the low melting glass 5 and the heat-resistant resin 6 in Example 1–8 but a similar tendency was shown even though the tubes were not sealed.

The sheathed heater of the present invention is not limited to the design shown in FIG. 1 and can include those heaters called cartridge and glow plug heaters.

The electrofused magnesia powder should be uniformly mixed with oxides. In this connection, however, with NiO, primary particles of NiO powder are fine and coagulate into secondary particles, so that it is difficult to disperse the oxide uniformly. A method of fabricating a sheathed resistance heater which is suitable for overcoming the above difficulty is described.

[EXAMPLE 9]

A metallic nickel powder, nickel nitrate, nickel carbonate, nickel oxalate, and nickel sulfate were roasted to obtain nickel oxide powders, respectively.

An electrofused magnesia powder was provided as a main component of the electrically insulating powder 4 and admixed with each of the nickel oxide powders obtained above in an amount of 1 wt%. These mixtures were used as the electrically insulating powder 4.

The electrofused magnesia powder used in this example had a composition indicated in table 12 below.

TABLE 12

| | |
|---|---|
| MgO | 96–97 wt % |
| CaO | 0.2–0.3 wt % |
| $SiO_2$ | 2–3 wt % |
| $Al_2O_3$ | 0.4–0.5 wt % |
| $Fe_2O_3$ | 0.14–0.16 wt % |

The heating wire 2 used was a nichrome wire of the first kind having a diameter of 0.29 in the form of a coil having a winding diameter of 2 mm. The wire was connected with terminal bars 1 at opposite ends thereof.

As the metal pipe 3, there was used a pipe, NCF 2P (commercial name Incoroi 800), having a length of 413 mm, an outer diameter of 8 mm and a thickness of 0.46 mm.

Into the metal pipe was inserted the heating wire 2 connected with the terminal bars at opposite ends thereof. Further, the electrically insulating powder 4 which had previously been prepared was filled up in the metal pipe 3, followed by the steps of rolling for reducing the pipe diameter and annealing (1050° C., 10 minutes) thereby making a metal pipe having a length of 500 mm and an outer diameter of 6.6 mm. The pipe was tightly sealed by the use of a low melting glass 5 and a heat-resistant resin 6 at opposite ends thereof to accomplish a sheathed resistance heater.

For comparison purposes, a known sheathed resistance heater was made using an electrofused magnesia powder alone as the electrically insulating powder 4.

The respective sheathed heaters were subjected to the measurement of an initial insulation resistance value at room temperature, insulation resistance value at a temperature on the pipe surface of 750° C. (hereinafter referred to as insulation resistance under self-heating conditions), and dielectric strength at room temperature. Sheathed resistance heaters which had an insulation resistance under self-heating conditions of below 1 mega ohms and a dielectric strength below 1000 V were determined as defectives and a fraction defective of each group was calculated. The results are shown in Table 13.

TABLE 13

| Sample | Starting Material for Nickel Oxide | Fraction Defective (%) Insulation Resistance under Self-heating Conditions | Dielectric Strength |
|---|---|---|---|
| 61 | Metalic Nickel | 4.87 | 21.90 |
| 62 | Nickel Nitrate | 3.17 | 2.16 |
| 63 | Nickel Carbonate | 2.01 | 1.89 |
| 64 | Nickel Oxalate | 1.25 | 3.21 |
| 65 | Nickel sulfate | 0.11 | 0.10 |
| 11 | — | 0.12 | 0.11 |

As will become apparent from Table 13, the sample 65 of the present invention showed such a low fraction defective as the sample 11 which made use of the electrically insulating powder 4 consisting of the electrofused magnesia powder alone.

On the other hand, the samples 61–64 which are outside the scope of the invention showed high fraction defectives.

[EXAMPLE 10]

The sheathed heaters of sample No. 65 according to the invention and sample No. 11 of the prior art in Example 9 were subjected to the life test and the test of the insulation resistance under self-heating conditions. (Life Test)

The heating wire 2 of each sheathed heater was energized so that the surface temperature of the metal pipe 3 was maintained at a temperature of 950° C. to determine the variation of the insulation resistance under self-heating conditions. It will be noted that when the insulation resistance under self-heating conditions was measured, the surface temperature was lowered down to 750° C.

The results of the life test and the insulation resistance values after 11 days in the test are shown in Table 14. The variation of the insulation resistance under self-heating conditions determined by the insulation resistance test is shown in FIG. 26.

Figure 26:
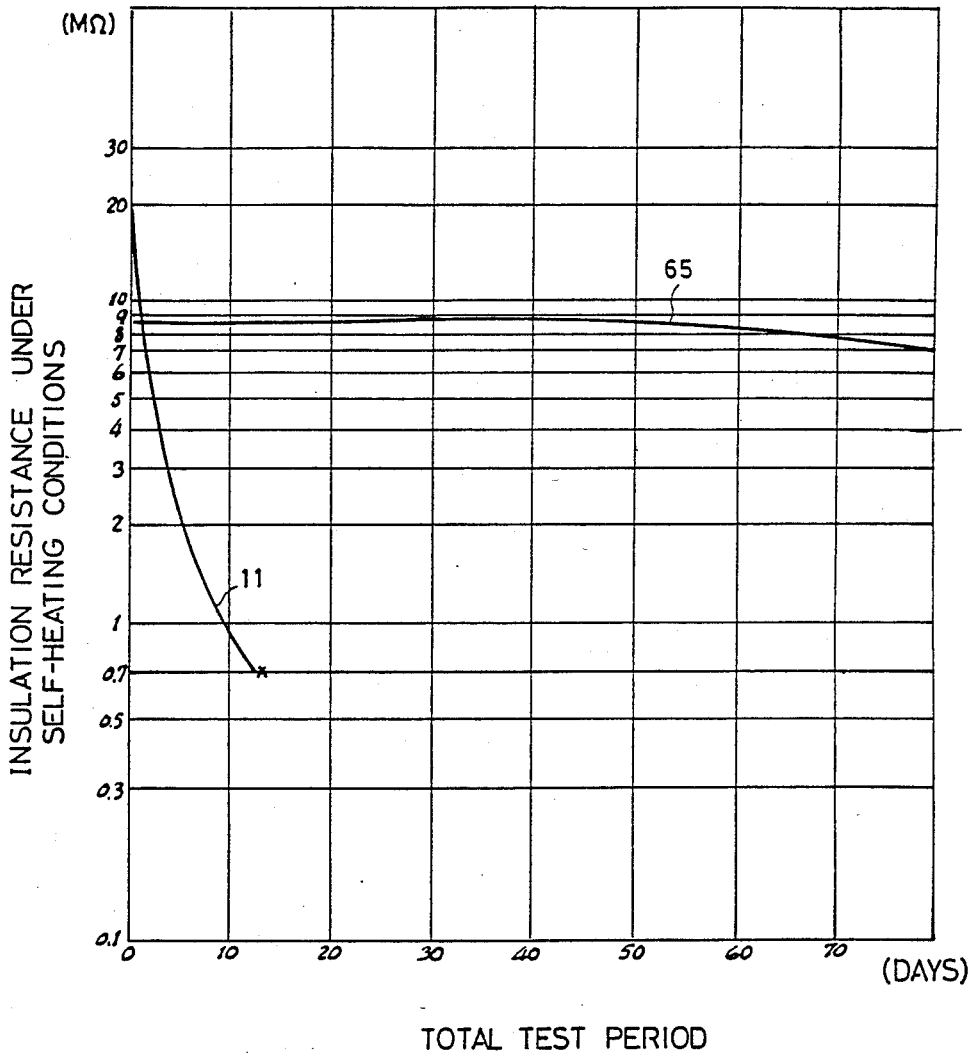

In FIG. 26, curves 65 and 11 correspond to the sample 65 of the invention and the sample 11 of the prior art embodiment, respectively.

TABLE 14

| Sample | Life (Days) | Insulation Resistance under Self-heating Conditions 11 Days after the Continuous Test |
|---|---|---|
| 65 | 125 | 8.5 |
| 11 | 13 | 0.95 |

As will be apparent from the results of Table 14 and FIG. 26, the sample 65 of the present invention had at least about 10 times the life of the known sample 11 and exhibited a higher value of the insulation resistance under self-heating conditions as measured 11 days after the continuous test.

Thus, the effect attained by the addition of the nickel oxide powder was kept at it is.

In this example, the electrofused magnesia powder was used as the electrically insulating powder but a similar tendency was shown when using, instead of the magnesia powder, electrofused alumina and silica powders.

As will be appreciated from the above example, according to the method of fabricating a sheathed resistance heater of the invention, the nickel oxide powder is produced by roasting nickel sulfate and is admixed with the main component to give an electrically insulating powder useful in the present invention. As a consequence, there can be provided a sheathed resistance heater which has a long life and a high insulation resistance under self-heating conditions even after having been used over a long time.

[EXAMPLE 11]

A metallic nickel powder (average size 3μ–7μ) was roasted at 900° C. for 2 hours and reduced into pieces having a size below 1μ to give a nickel oxide powder.

An electrofused magnesia powder used as a main component of the electrically insulating powder 4 was admixed with 1 wt% of the nickel oxide powder to obtain a mixed powder. This mixed powder was provided as electrically insulating powder 4. The electrofused magnesia powder, the heating wire and the metal pipe were same as used in Example 9.

The heating wire 2 connected with the terminal bars at opposite ends thereof was inserted into the metal pipe 3, which was then filled up with the electrically insulating powder 4 which had been previously prepared. The pipe was subsequently subjected to the steps of rolling for reducing its diameter and annealing (1050° C., 10 minutes) to make a pipe of 500 mm in length and 6.6 mm in outer diameter. The metal pipe 3 was tightly sealed at opposite ends thereof with a low melting glass 5 and a heat-resistant resin 6 to accomplish a sheathed resistance heater of sample No. 66.

For comparison purposes, there were fabricated known sheathed resistance heaters of sample No. 11 in which the electrofused magnesia powder alone was used as the electrically insulating powder and of sample No. 67 in which the electrofused magnesia powder admixed with 1 wt% of a commercially available nickel oxide powder was used as the electrically insulating powder 4.

The finished sheathed heaters were each subjected to the measurement of an insulation resistance at a pipe surface temperature of 750° C. immediately after the fabrication, and also to the life and insulation resistance tests described below.

(Life Test)

The heating wire of each of the sheathed heaters was energized so that the surface temperature of the metal pipe 3 was maintained at 950° C. to check the number of days before disconnection of the wire.

(Insulation Resistance Test Under Self-heating Conditions)

The heating wire 2 of each of the sheathed heaters was energized so that the surface temperature of the metal pipe 3 was maintained at 950° C. to determine the variation of the insulation resistance under self-heating conditions. It will be noted that the measurement of the insulation resistance was effected after lowering the surface temperature of the metal pipe 3 down to 750° C.

Figure 27:
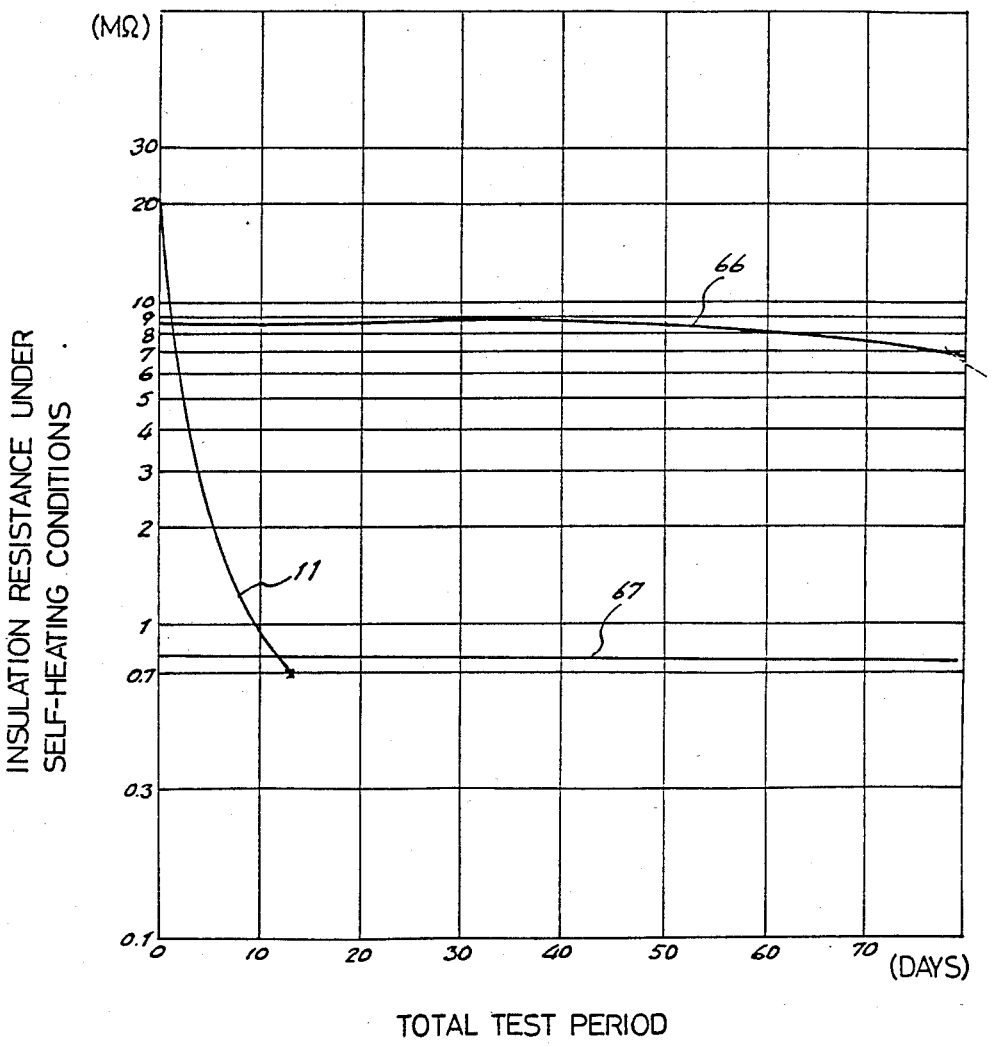

In Table 15, there are shown the results of the insulation resistance under self-heating conditions measured immediately after the fabrication, and the life test and the insulation resistance under self-heating conditions measured after 11 days in the insulation resistance test. Moreover, the variation of the insulation resistance observed during the insulation resistance test is shown in FIG. 27. In FIG. 27, curves 66, 11 and 67 correspond to the inventive sheathed heater 66, and the known heaters 11 and 67, respectively.

TABLE 15

| Sample | Insulation Resistance under Self-heating Conditions Immediately After Fabrication (Mega Ohms) | Life (Days) | Insulation Resistance under Self-heating Conditions after 11 Days (Mega Ohms) |
|---|---|---|---|
| 66 | 8.5 | 111 | 8.5 |
| 11 | 20 | 13 | 0.95 |
| 67 | 0.8 | 109 | 0.8 |

As will become apparent from the results of Table 15 and FIG. 27, the known sample 67 in which the commercially available nickel oxide powder was used considerably lowers in the insulation resistance as compared with the known sample 11 in which the electrofused magnesia powder alone was used. With the embodiment of the invention in which the nickel oxide powder prepared according to the invention was used, its insulation resistance is smaller than that of the known sample 11 but is much higher than that of the known sample 67. Thus, the present invention is very effective.

The nickel oxide powder of the invention gives a great effect: the life is at least about ten times longer than the life of the known sample 11 with the insulation resistance under self-heating conditions measured 11 days after the continuous test being also higher.

In this example, the electrofused magnesia powder was used as a main component of the electrically insulating powder but a similar tendency is shown when using, instead of the electrofused magnesia powder, electrofused alumina and silica powders.

The method of fabricating a sheathed resistance heater according to the invention is a method in which there is used an electrically insulating powder to which is added a nickel oxide powder produced by roasting metallic nickel powder. By this, there can be provided a sheathed resistance heater which has a long life and a high insulation resistance under self-heating conditions after long-term use.

[EXAMPLE 12]

A metallic nickel powder (average particle 3 microns–7 microns) was roasted at 900° C. for 2 hours and reduced to pieces to obtain nickel oxide particles.

The nickel oxide particles were classified into three groups including a group of particles having a size over 10 microns, a group of particles having a size ranging from 10 microns–5 microns, and a group of particles having a size below 5 microns.

Thereafter, the particles were granulated to a level of 250 microns using water as a binder to give nickel oxide granules.

An electrofused magnesia powder was provided as a main component and admixed with 1 wt% of the nickel oxide granules prepared by the above method to give a sample electrically insulating powder 4.

The electrofused mgnesia powder, heating wire and metal powder used in this example were same as those used in Example 9.

Into the metal pipe 3 was inserted the heating wire 2 connected with the terminal bars 1 at opposite ends thereof. The pipe was filled up with the electrically insulating powder 4, followed by the steps of rolling for reducing the diameter and annealing (1050° C., 10 minutes), with the result that it has a length of 500 mm and an outer diameter of 6.6 mm. The resulting pipe 3 was tightly sealed at opposite ends thereof with a low melting glass 5 and a heat-resistant resin 6 to accomplish a sheathed resistance heater of sample No. 68.

[EXAMPLE 13]

A metallic nickel powder (average size 3 microns–7 microns) was roasted at 900° C. for 2 hours and ground to a level of below 5 microns, after which the powder was granulated by the use of water as a binder to provide nickel oxide granules. The granulation was effected so that the size was classified into groups of 420 microns–350 microns, 350 microns–297 microns, 297 microns–250 microns, 250 microns–177 microns, 177 microns–105 microns and below 105 microns.

Thereafter, Example 12 was repeated thereby obtaining sheathed resistance heaters numbered as 69.

[EXAMPLE 14]

Nickel sulfate was crystallized from a nickel sulfate solution, after which the nickel sulfate crystals were roasted at 1000° C. for 2 hours, followed by grinding to a level of below 5 microns. The powder was granulated using water as a binder to obtain particles having a size below 250 microns thereby providing a sample of nickel oxide granules.

Subsequently, the general procedure of Example 12 was repeated to accomplish a sheathed resistance heater of sample No. 70.

For comparison purposes, there were made prior art sheathed resistance heaters including a heater making use of an electrofused magnesia powder as the electrically insulating powder 4 (sample No. 11) and a heater of sample No. 71 in which the an electrically insulating powder used was in admixture with 1 wt% of a commercially available nickel oxide powder which was produced from a starting metallic nickel powder. In addition, a sheathed resistance heater of sample No. 72 was fabricated in which there was used an electrofused magnesia powder admixed with 1 wt% of a commercially available nickel oxide produced from starting nickel sulfate.

The sheathed resistance heaters fabricated in Examples 12–14 and the prior-art heaters were classified, as shown in Table 16, according to the size of the primary particles of the added nickel oxide particles and the size of the granulated particles.

The respective sheathed resistance heaters were subjected to the measurement of an initial insulation resistance at room temperature immediately after their fabrication, insulation resistance at a temperature on the pipe surface of 750° C., and dielectric strength at room temperature. Sheathed heaters which had an insulation resistance under self-heating conditions of below 1 mega ohms and a dielectric strength of below 1000 V were determined as a defective and fraction defectives in the respective groups were calculated. The results are shown in Table 16.

TABLE 16

| Sample | Group | Nickel Oxide Size (μ) | Nickel Oxide Size of Granulated Particles | Fraction Defective (%) Insulation Resistance Under Self-heating Conditions | Fraction Defective (%) Dielectric Strength |
|---|---|---|---|---|---|
| 68 | A | over 10μ | below 250μ | 15.2 | 10.1 |
| | B | 10μ–5μ | " | 9.4 | 8.5 |
| | C | below 5μ | " | 0.11 | 0.12 |
| 69 | D | below 5μ | 420μ–350μ | 3.2 | 25.6 |
| | E | " | 350μ–297μ | 2.5 | 19.8 |
| | F | " | 297μ–250μ | 1.7 | 5.2 |
| | G | " | 250μ–177μ | 0.09 | 0.10 |
| | H | " | 177μ–105μ | 0.10 | 0.12 |
| | I | " | below 105μ | 0.08 | 0.09 |
| 70 | J | below 5μ | below 250μ | 0.11 | 0.13 |
| 11 | K | — | — | 0.12 | 0.13 |
| 71 | L | commercially available nickel oxide | | 3.2 | 4.1 |
| 72 | M | commercially available nickel oxide | | 2.5 | 21.8 |

(Note)
L: Commercially available nickel oxide powder derived from metallic nickel.
M: Commercially availabe nickel oxide powder derived from nickel sulfate.

Among the sample Nos. 68–72, the sheathed heaters of Groups C, G, H, I, J and K whose fraction defectives are below 1% were further subjected to the life test and the insulation resistance test under self-heating conditions.

(Life Test)

The heating wire 2 of each heater was energized so that the surface temperature of the metal pipe 3 was maintained at 950° C. to determine the number of days prior to disconnection of the wire 2.

(Insulation Resistance Test Under Self-heating Conditions)

The heating wire 2 was energized so that the surface temperature of the metal pipe 3 was maintained at 950° C. to determine a variation of insulation resistance. It will be noted that the measurement of the insulation resistance was effected after lowering the surface temperature of the metal pipe 3 down to 750° C.

The results of the life test and the insulation resistance test after 11 days are shown in Table 17.

TABLE 17

| Sample No. | Group | Life (Days) | Insulation Resistance Under Self-heating Conditions After 11 Days (Mega Ohms) |
|---|---|---|---|
| 68 | D | 122 | 8.5 |
| | H | 124 | 8.3 |
| 69 | I | 118 | 8.4 |
| | J | 131 | 8.6 |
| 70 | K | 125 | 8.5 |
| 71 | L | 13 | 0.95 |

As will be apparent from Table 16, samples L and M in which the commercially available nickel oxide powders were used are much higher in fraction defective than sample K making use of the magnesia powder alone as the electrically insulating powder 4 but the size of the nickel oxide particles is below 5 microns. Samples C, G, H, U and J of Examples 12–14 in which the nickel oxide particles granulated to have sizes below 250 microns show almost the same level of fraction defective as sample K.

However, when particles or granulated particles of sizes larger than 250 microns are used, they are poor in dispersability upon mixing with the magnesia powder. As a result, such nickel oxide particles may be present as larger-size particles, or may segregate in some portions of sheathed heater such as by vibrations occurring upon filling of the particles. These phenomena will cause very high fraction defectives with regard to the insulation resistance and particularly the dielectric strength, presenting serious problems in the fabrication of the heaters.

On the other hand, samples C, G, H, I and J and the prior-art sample K which were low in fraction defective as particularly shown in Table 16 were subjected to the life and insulation resistance tests to compare the characteristics of these heaters with one another. As will be apparent from Table 17, the life was about 10 times as long as that of the heater K using the known magnesia powder alone and the insulation resistance values under self-heating conditions measured 11 days after commencement of the test were kept at high levels.

In Examples 12–14, the electrofused magnesia powder was used as a main component of the electrically insulating powder. In this connection, a similar tendency was found to be shown when using electrofused alumina and silica powders instead of the electrofused magnesia powder.

As will be appreciated from the above description, the method of fabricating a sheathed resistance heater according to the invention is a method which comprises granulating nickel oxide particles ground to a level below 5 microns into granules having a size below 250 microns and adding the granules to an electrically insulating powder, with the result that there is stably provided a heater which has a long life and a high insulation resistance value under self-heating conditions after having been used over a long term.

INDUSTRIAL UTILIZABILITY

As described hereinbefore, according to the present invention, there can be obtained a sheathed resistance heater of long life and high insulation resistance under self-heating conditions after long-term use by using an electrically insulating powder admixed with 0.1–10 wt% of at least one oxide selected from the group consisting of NiO, CoO, $Co_2O_3$, $Co_3O_4$, $Fe_2O_3$, $Fe_3O_4$, $WO_3$, CuO, $Ga_2O_3$, SnO2, and ZnO.

We claim:

1. A sheathed resistance heater comprising a metal pipe, an electrical metal heating wire received in said metal pipe, and an electrically insulating powder composition filling said metal pipe, said electrically insulating powder composition including at least one electrically insulating powder uniformly mixed with 0.1–10 wt.% of at least one oxide selected from the group consisting of NiO, CoO, and mixtures thereof, so that said electrical metal heating wire is insulated from said metal pipe by said insulating powder composition and said at least one oxide prolongs the insulation resistance and life of said sheathed resistance heater.

* * * * *